United States Patent [19]

Kojima et al.

[11] Patent Number: 4,791,049

[45] Date of Patent: Dec. 13, 1988

[54] SILVER HALIDE PHOTOGRAPHIC MATERIAL CONTAINING A COMPOUND HAVING AN OXIDATION-REDUCTION MOIETY AND TIMING GROUP

[75] Inventors: Tetsuro Kojima; Shigeo Hirano; Hideo Usui, all of Kanagawa, Japan

[73] Assignee: Fuji Photo Film Co., Ltd., Kanagawa, Japan

[21] Appl. No.: 41,570

[22] Filed: Apr. 23, 1987

[30] Foreign Application Priority Data

Apr. 25, 1986 [JP] Japan ..... 61-96094

[51] Int. Cl.[4] ..... G03C 1/08; G03C 1/46; G03C 7/26; G03C 7/32

[52] U.S. Cl. ..... 430/544; 430/443; 430/503; 430/505; 430/543; 430/552; 430/553; 430/554; 430/555; 430/556; 430/557; 430/558; 430/955; 430/957; 430/959; 430/960

[58] Field of Search ..... 430/957, 443, 544, 955, 430/959, 960, 599, 543, 552-558, 503, 505

[56] References Cited

U.S. PATENT DOCUMENTS

| | | | |
|---|---|---|---|
| 4,248,962 | 2/1981 | Lau | 430/544 |
| 4,409,323 | 10/1983 | Sato et al. | 430/544 |
| 4,518,685 | 5/1985 | Yagihara et al. | 430/505 |
| 4,629,683 | 12/1986 | Itoh et al. | 430/484 |
| 4,639,408 | 1/1987 | Kitaguchi et al. | 430/957 |
| 4,678,739 | 7/1987 | Kitaguchi et al. | 430/957 |
| 4,695,525 | 9/1987 | Tsukase et al. | 430/957 |

FOREIGN PATENT DOCUMENTS

| | | |
|---|---|---|
| 1531927 | 10/1978 | United Kingdom . |
| 2096783 | 10/1982 | United Kingdom . |

*Primary Examiner*—Mukund J. Shah

*Attorney, Agent, or Firm*—Sughrue, Mion, Zinn, Macpeak, and Seas

[57] ABSTRACT

A silver halide photographic material comprising a support having thereon at least one silver halide emulsion layer, wherein the silver halide photographic material contains at least one compound represented by the following general formula (I):

$$A\text{-}(\text{Time})_t\text{-}X \qquad (I)$$

wherein A represents an oxidation reduction moiety comprising an atomic group which does not enable $\text{-}(\text{Time})_t\text{-}X$ to be released until the oxidation reduction moiety is oxidized during photographic development processing; Time represents a timing group which is connected to A through a sulfur atom, a nitrogen atom or an oxygen atom; t represents an integer of 0 or 1; and X represents a group represented by the following general formula (II):

(II)

wherein R represents a straight chain or branched chain alkylene group, a straight chain or branched chain alkenylene group, a straight chain or branched chain aralkylene group or an arylene group; Z represents a polar substituent; Y represents $R_1$, $R_2$, $R_3$, $R_4$, $R_5$, $R_6$, $R_7$ and $R_8$ each represents a hydrogen atom, a substituted or unsubstituted alkyl group, a substituted or unsubstituted aryl group, a substituted or unsubstituted alkenyl group or a substituted or unsubstituted aralkyl group; and n represents an integer of 0 or 1. The silver halide photographic material exhibits a large interimage effect without deterioration of other photographic properties and thus provides photographic images excellent in sharpness and graininess.

14 Claims, No Drawings

SILVER HALIDE PHOTOGRAPHIC MATERIAL CONTAINING A COMPOUND HAVING AN OXIDATION-REDUCTION MOIETY AND TIMING GROUP

FIELD OF THE INVENTION

The present invention relates to a silver halide photographic material which exhibits an increased interimage effect and which is improved in sharpness and graininess.

BACKGROUND OF THE INVENTION

It is known that upon color development of silver halide color photographic materials, the oxidation products of aromatic primary amine color developing agents react with couplers to form indophenol, indoaniline, indamine, azomethine, phenoxazine, phenazine and similar dyes, thereby forming color images. In this system, color reproduction is usually accomplished by the subtractive color process; silver halide emulsions selectively sensitive to blue, green and red, and yellow, magenta and cyan color image-forming agents in a complementary relation therewith are used. For example, acylacetanilide or dibenzoylmethane type couplers are used to form yellow color images; pyrazolone, pyrazolobenzimidazole, pyrazolopyrazole, pyrazolotriazole, cyanoacetophenone or idazolone type couplers are mainly used to form magenta color images; and phenol type couplers, such as phenols and naphthols, are mainly used to form cyan color images.

Dyes formed from these couplers do not have ideal spectral absorption spectra. In particular, magenta dyes and cyan dyes have broad absorption spectra or undesirable subsidiary absorptions in a short wavelength region and thus they are not preferred in view of color reproduction of color photographic light-sensitive materials. Especially, the subsidiary absorption in a short wavelength region tends to bring about a decrease in saturation.

The decrease in saturation can be controlled to a certain extent by utilizing exhibition of an interimage effect. With respect to the interimage effect, this is described, for example, in Hanson et al., *Journal of the Optical Society of America,* Vol. 42, pages 663 to 669, and A. Thiels, *Zeitschrift für Wissenschaftliche Photographie, Photophysique und Photochemie,* Vol. 47, pages 106 to 118 and 246 to 255.

Methods for obtaining perferable interimage effects are described in U.S. Pat. No. 3,536,486 wherein a diffusible 4-thiazoline-2-thione is incorporated into an exposed color reversal photographic element and in U.S. Pat. No. 3,536,487 wherein a diffusible 4-thiazoline-2-thione is incorporated into an unexposed color reversal photographic element.

Japanese Patent Publication No. 34169/73 (corresponding to U.S. Pat. No. 3,723,125) discloses that a remarkable interimage effect is obtained using a N-substituted 4-thiazoline-2-thione compound in the reduction of from silver halide to silver by the development of color photographic materials.

Further, providing a colloidal silver-containing layer between a cyan layer and a magenta layer in a color reversal photographic element for the purpose of obtaining a preferred interimage effect is described in *Research Disclosure,* No. 13116 (1975).

Moreover, a method for obtaining a favorable interimage effect is described in U.S. Pat. No. 4,082,553 wherein a color reversal photographic material having a layer arrangement which enables iodine ions to be mobilized during development comprises one layer containing silver haloiodide grains capable of forming latent images and another layer containing silver halide grains capable of forming latent images and surface fogged silver halide grains capable of being developed irrespectively of image exposure.

However, these methods described above still only provide an insufficient interimage effect and further the use of a layer containing colloidal silver and the incorporation of fogged silver halide grains have a severe problem in that a decrease in color density accompanies the color reversal photographic materials.

Furthermore, it is also known that an interimage effect can be achieved by using couplers (DIR couplers) capable of releasing development inhibiting substances such as benzotriazole derivatives or mercapto compounds at the time of the coupling reaction with oxidation products of color developing agents or hydroquinone compounds capable of releasing development inhibiting substances such as iodine ions or mercapto compounds at the time of development as described in U.S. Pat. Nos. 3,379,529, 3,620,746, 4,377,634 and 4,332,878, Japanese Patent Application (OPI) No. 129536/74 (corresponding to U.S. Pat. No. 3,930,863) (the term "OPI" as used herein refers to a "published unexamined Japanese patent application"), Japanese Patent Publication No. 24462/85, etc. However, the use of these compounds is attended by severe desensitization and causes a decrease in color density. Thus, their use is restricted.

SUMMARY OF THE INVENTION

Therefore, an object of the present invention is to provide a multilayer color photographic light-sensitive material which exhibits a large interimage effect without damaging other photographic properties.

Another object of the present invention is to provide a silver halide photographic material excellent in sharpness.

A further object of the present invention is to provide a black-and-white silver halide photographic material having high sharpness and good graininess.

Other objects of the present invention will become apparent from the following detailed description and examples.

These objects of the present invention can be accomplished by providing a silver halide photographic material comprising a support having thereon at least one silver halide emulsion layer, wherein the silver halide photographic material contains at least one compound represented by the following general formula (I):

$$A\text{-}(\text{Time})_t X \qquad (I)$$

wherein A represents an oxidation reduction moiety comprising an atomic group which does not enable $\text{-}(\text{Time})_t X$ to be released until the oxidation reduction moiety is oxidized during photographic development processing; Time represents a timing group which is connected to A through a sulfur atom, a nitrogen atom or an oxygen atom; t represents an integer of 0 or 1; and X represents a group represented by the following general formula (II):

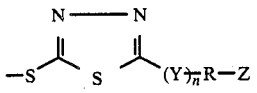

(II)

wherein R represents a straight chain or branched chain alkylene group, a straight chain or branched chain alkenylene group, a straight chain or branched chain aralkylene group or an arylene group; Z represents a polar substituent; Y represents

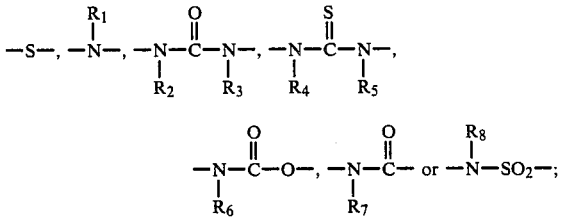

$R_1$, $R_2$, $R_3$, $R_4$, $R_5$, $R_6$, $R_7$ and $R_8$ each represents a hydrogen atom, a substituted or unsubstituted alkyl group, a substituted or unsubstituted aryl group, a substituted or unsubstituted alkenyl group or a substituted or unsubstituted aralkyl group; and n represents an integer of 0 or 1.

DETAILED DESCRIPTION OF THE INVENTION

The compound represented by the general formula (I) which can be used in the present invention is described in detail below.

In the general formula (I), the oxidation reduction moiety represented by A includes, for example, a hydroquinone, a catechol, a p-aminophenol, an o-aminophenol, a 1,2-naphthalenediol, a 1,4-naphthalenediol, a 1,6-naphthalenediol, a 1,2-aminonaphthol, a 1,4-aminonaphthol or a 1,6-aminonaphthol, etc. The amino groups include therein are preferably substituted with a sulfonyl group having from 1 to 25 carbon atoms or an acyl group having from 1 to 25 carbon atoms. The sulfonyl group includes a substituted or unsubstituted aliphatic sulfonyl group and a substituted or unsubstituted aromatic sulfonyl group. The acyl group includes a substituted or unsubstituted aliphatic acyl group and a substituted or unsubstituted aromatic acyl group.

The hydroxy group or amino group included in the oxidation reduction moiety represented by A may be protected by a protective group capable of being removed at the time of development processing. Examples of suitable protective groups include a group having from 1 to 25 carbon atoms, for example, an acyl group, an alkoxycarbonyl group and a carbamoyl group, and the protective groups as described in Japanese Patent Application (OPI) Nos. 197037/84 and 201057/84 (corresponding to U.S. Pat. Nos. 4,629,683 and 4,518,685, respectively), etc. Further, the protective group may, if possible, connect with a substituent for A described hereinafter to form a 5-membered, 6-membered or 7-membered ring.

The oxidation reduction moiety represented by A can be substituted with one or more suitable substituents. Examples of suitable substituents include a group having up to 25 carbon atoms, for example, an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxyl group, a sulfo group, a nitro group, a heterocyclic group or $\text{-(Time)}_n\text{X}$, etc. These substituents may be further substituted with one or more of the abovedescribed substituents. Moreover, these substituents may connect with each other to form a saturated or unsaturated carbocyclic group or a saturated or unsaturated heterocyclic group.

Preferred examples for the oxidation reduction moiety represented by A include a hydroquinone, a catechol, a p-aminophenol, an o-aminophenol, a 1,4-naphthalenediol and a 1,4-aminonaphthol, etc. More preferred examples for A include a hydroquinone, a catechol, a p-aminophenol and an o-aminophenol. The most preferred moiety is a hydroquinone.

Preferred examples of the moiety represented by A in the general formula (I) are specifically set forth below, but the present invention should not be construed as being limited thereto. In the following formulae, a symbol (*) denotes the position at which $\text{-(Time)}_n\text{X}$ is bonded.

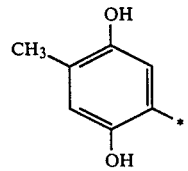

(1)

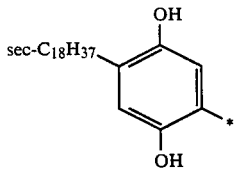

(2)

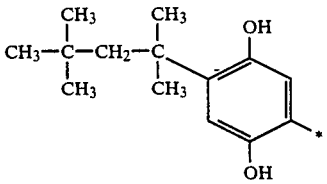

(3)

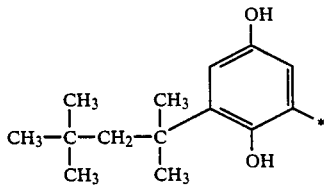

(4)

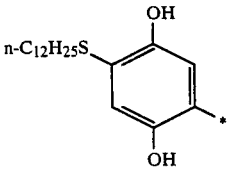

(5)

-continued
(6)
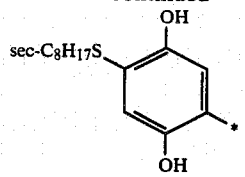
(7)
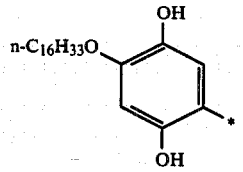
(8)
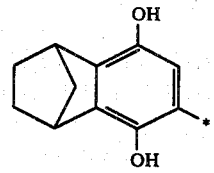
(9)
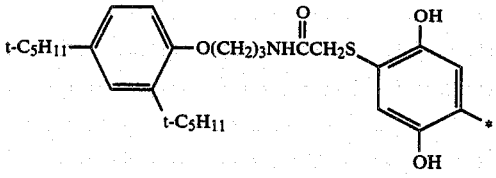
(10)
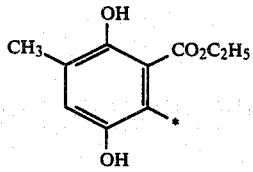
(11)
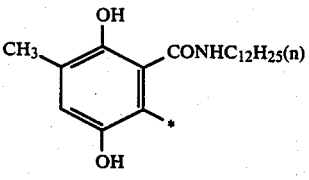
(12)
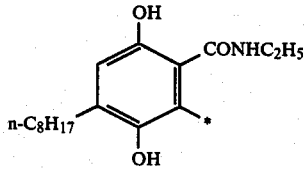
(13)
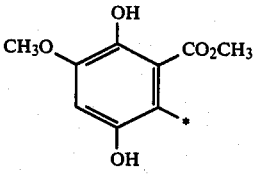
(14)
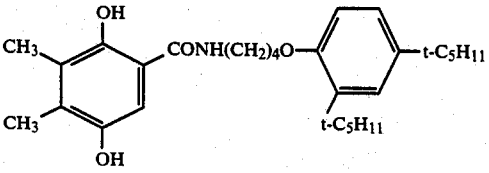
-continued
(15)
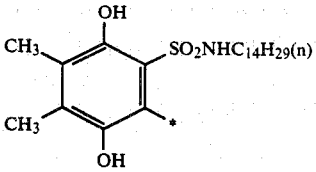
(16)
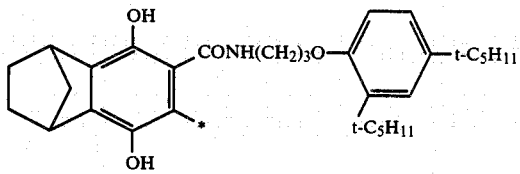
(17)
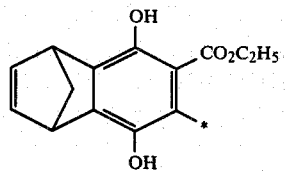
(18)
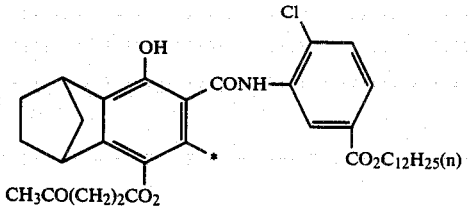
(19)
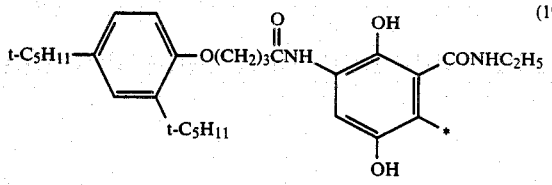
(20)
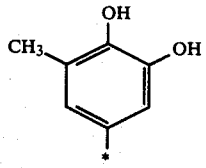
(21)
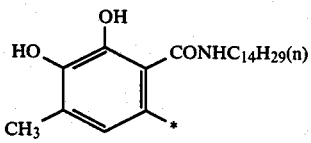
(22)
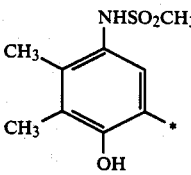
(23)
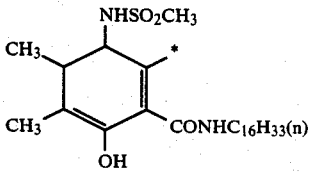

-continued (24)

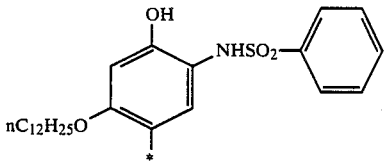

(25)

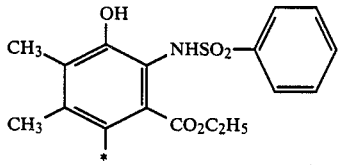

(26)

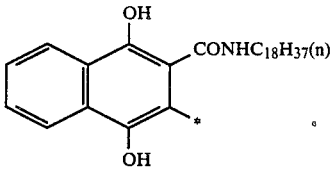

(27)

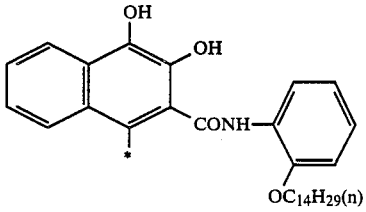

(28)

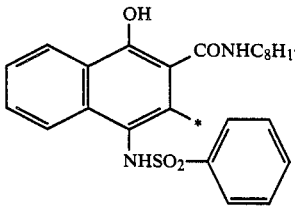

(29)

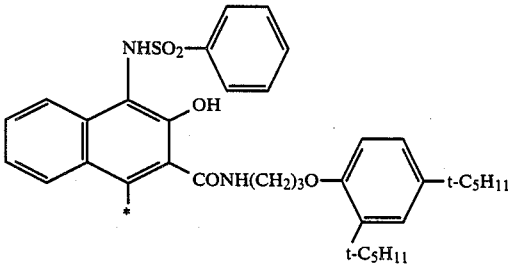

In the general formula (I), $-(\text{Time})_{\overline{n}}X$ is a group which is not released as $\overset{\ominus}{-}(\text{Time})_{\overline{n}}X$ until the oxidation reduction moiety represented by A in the general formula (I) causes a cross oxidation reaction at the time of development to change into an oxidation product.

Time in the general formula (I) is a timing group connected to A through a sulfur atom, a nitrogen atom or an oxygen atom and includes a group capable of releasing X from $\overset{\ominus}{-}(\text{Time})_{\overline{n}}X$ released at the time of development through one or more reaction stages. Suitable examples of the timing group represented by Time include those as described, for example, in U.S. Pat. Nos. 4,248,962, 4,409,323 and 4,146,396, British Pat. No. 2,096,783, Japanese Patent Application (OPI) Nos. 146828/76 and 56837/82, etc. A combination of two or more timing groups selected from these groups described above may be employed for Time.

Particularly preferable timing groups represented by Time in the general formula (I) are those represented by the following general formulae wherein a symbol (*) denotes the position at which the oxidation reduction moiety is bonded, and a symbol (**) denotes the position at which X (PUG) is bonded. Time may also be a combination of the following two or more formulae.

(T-1)

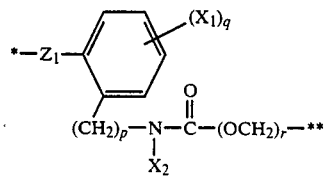

wherein $Z_1$ represents

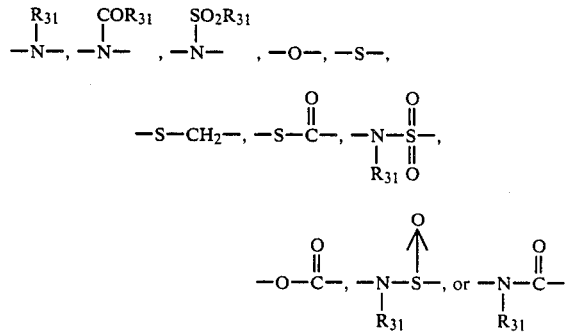

wherein $R_{31}$ represents a hydrogen atom, an aliphatic group, an aromatic group, or a heterocyclic group; $X_1$ represents a hydrogen atom, an aliphatic group, an aromatic group, a heterocyclic group,

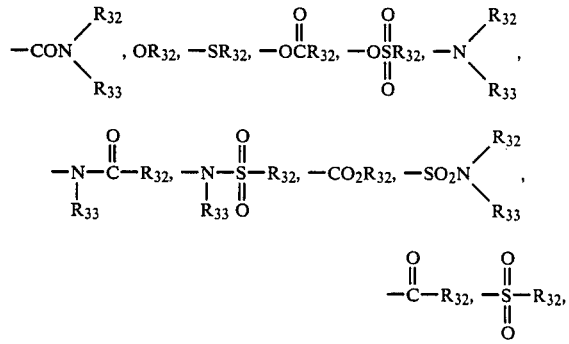

a cyano group, a halogen atom (e.g., a fluorine atom, a chlorine atom, a bromine atom, an iodine atom) or a nitro group wherein $R_{32}$ and $R_{33}$ may be the same or different and each represents the same group as defined for $R_{31}$; $X_2$ represents the same group as defined for $R_{31}$; q represents an integer of from 1 to 4, and when q is 2 or more, the substituents represented by $X_1$ may be the same or different, and when q is 2 or more, $X_1$ may connect with each other to form a ring; p represents 0, 1, or 2; and r represents 0 or 1.

The groups represented by the general formula (T-1) are described, for example, in U.S. Pat. No. 4,248,962.

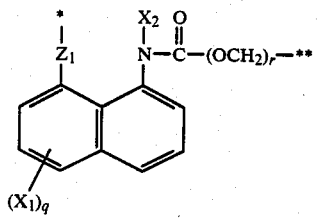

(T-2)

wherein $Z_1$, $X_1$, $X_2$, q and r each has the same meaning as defined for the general formula (T-1).

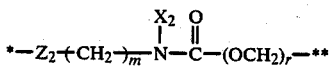

(T-3)

wherein $Z_2$ represents

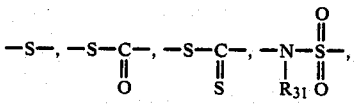

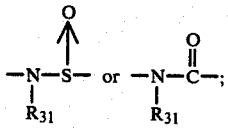

m represents an integer of from 1 to 4, preferably being 1, 2 or 3; and $R_{31}$, $X_2$ and r each has the same meaning as defined for the general formula (T-1).

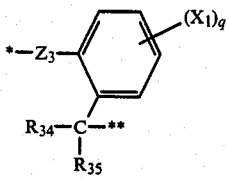

(T-4)

wherein $Z_3$ represents

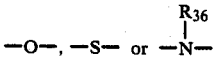

wherein $R_{36}$ represents an aliphatic group, an aromatic group, an acyl group, a sulfonyl group or a heterocyclic group; $R_{34}$ and $R_{35}$ each has the same meaning as $R_{31}$ defined for the general formula (T-1); and $X_1$ and q each has the same meaning as defined for the general formula (T-1).

An example of the group represented by the general formula (T-4) is the timing group as described in U.S. Pat. No. 4,409,323.

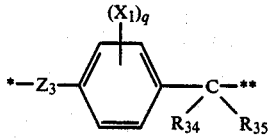

(T-5)

wherein $Z_3$, $X_1$, $R_{34}$, $R_{35}$, and q each has the same meaning as defined for the general formula (T-4).

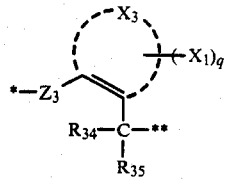

(T-6)

wherein $X_3$ represents an atomic group which comprises at least one atom selected from a carbon atom, a nitrogen atom, an oxygen atom and a sulfur atom and which is necessary to form a 5-membered, 6-membered or 7-membered heterocyclic ring, which may be further condensed with a benzene ring or a 5-membered, 6-membered or 7-membered heterocyclic ring. Examples of preferable heterocyclic rings include pyrrole, pyrazole, imidazole, triazole, furan, oxazole, thiophene, thiazole, pyridine, pyridazine, pyrimidine, pyrazine, azepin, oxepin, indole, benzofuran, quinoline, etc., $R_{34}$, $R_{35}$, $Z_3$, $X_1$ and q each has the same meaning as defined for the general formula (T-4).

An example of the group represented by the general formula (T-6) is the timing group as described in British Pat. No. 2,096,783.

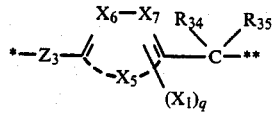

(T-7)

wherein $X_5$ represents an atomic group which comprises at least one atom selected from a carbon atom, a nitrogen atom, an oxygen atom and a sulfur atom and which is necessary to form a 5-membered, 6-membered or 7-membered heterocyclic ring, which may be further condensed with a benzene ring or a 5-membered, 6-membered or 7-membered heterocyclic ring. Examples of preferable heterocyclic rings include pyrrole, imidazole, triazole, furan, oxazole, oxadiazole, thiophene, thiazole, thiadiazole, pyridine, pyridazine, pyrimidine, pyrazine, azepin, oxepin, isoquinolien, etc. $X_6$ and $X_7$ each represents

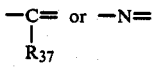

wherein $R_{37}$ represents a hydrogen atom, an aliphatic group or an aromatic group; and $R_{34}$, $R_{35}$, $Z_3$, $X_1$ and q each has the same meaning as defined for the general formula (T-4).

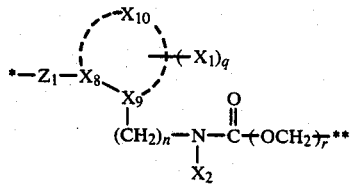

(T-8)

wherein $X_{10}$ represents an atomic group which comprises at least one atom selected from a carbon atom, a nitrogen atom, an oxygen atom, and a sulfur atom and which is necessary to form a 5-membered, 6-membered or 7-membered heterocyclic ring, which may be further condensed with a benzene ring or a 5-membered, 6-membered or 7-membered heterocyclic ring. Examples of preferable heterocyclic rings include pyrrolidine, piperidine and benzotriazole besides those described for the general formula (T-6). $X_8$ and $X_9$ each represents $$-\overset{|}{C}= \text{ or } -\overset{|}{N}-;$$

and $Z_1$, $X_1$, $X_2$, n, q and r each has the same meaning as defined for the general formula (T-1).

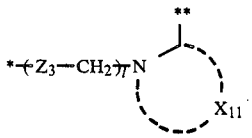

(T-9)

wherein $X_{11}$ has the same meaning as $X_{10}$ defined for the general formula (T-8); $Z_3$ has the same meaning as defined for the general formula (T-4); and l represents 0 or 1.

In the above-described general formula (T-9), the preferred examples of the heterocyclic ring represented by

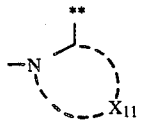

are as follows.

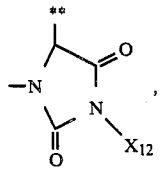

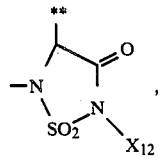

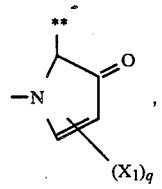

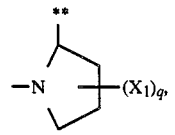

-continued

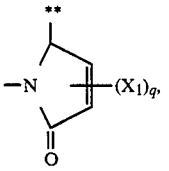

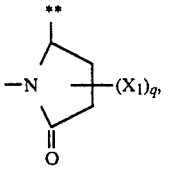

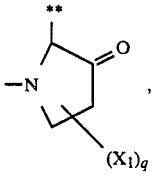

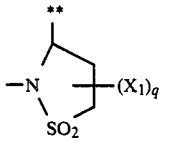

wherein $X_1$ and q each has the same meaning as defined for the general formula (T-1); and $X_{12}$ represents a hydrogen atom, an aliphatic group, an aromatic group, an acyl group, a sulfonyl group, an alkoxycarbonyl group, an sulfamoyl group, a heterocyclic group, or a carbamoyl group.

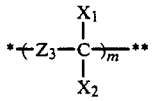

(T-10)

wherein $X_1$ and $X_2$ each has the same meaning as defined for the general formula (T-1); $Z_3$ has the same meaning as defined for the general formula (T-4); and m has the same meaning as defined for the general formula (T-3) and is preferably 1 or 2.

In the above-described general formulae (T-1) to (T-10), when $X_1$, $X_2$, $R_{31}$ to $R_{37}$ represent an aliphatic group or contain a moiety of an aliphatic group, the aliphatic group preferably has from 1 to 20 carbon atoms and may be saturated or unsaturated, substituted or unsubstituted, straight chain, branched chain or cyclic. When $X_1$, $X_2$, $R_{13}$ to $R_{37}$ described above represent an aromatic group or contain a moiety of an aromatic group, the aromatic group has from 6 to 20 carbon atoms, preferably from 6 to 10 carbon atoms, and is more preferably a substituted or unsubstituted phenyl group. Further, when $X_1$, $X_2$, $R_{31}$ to $R_{37}$ described above represent a heterocyclic group or contain a moiety of a heterocyclic group, the heterocyclic group is a 5-membered or 6-membered heterocyclic group containing at least one of a nitrogen atom, an oxygen atom and a sulfur atom as a hetero atom. Examples of preferable heterocyclic groups include a pyridyl group, a furyl group, a thienyl group, a triazolyl group, an imidazolyl group, a pyrazolyl group, a thiadiazolyl group, an oxadiazolyl group and a pyrrolidinyl group.

Specific examples of preferred timing groups are set forth below, but the present invention should not be construed as being limited thereto.
(1)
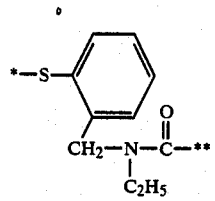
(2)
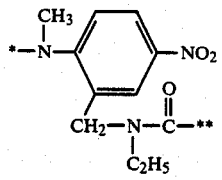
(3)
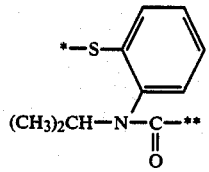
(4)
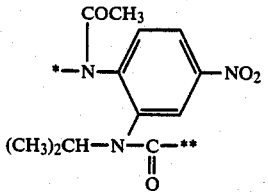
(5)
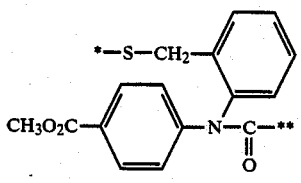
(6)
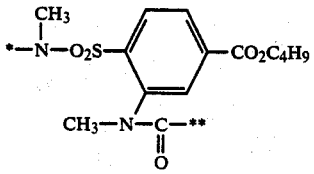
(7)
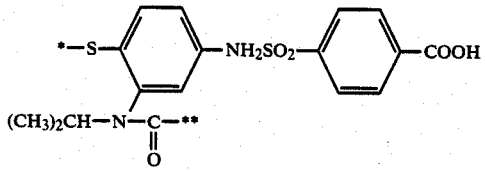
(8)
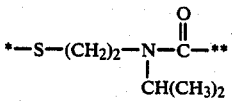
-continued
(9)
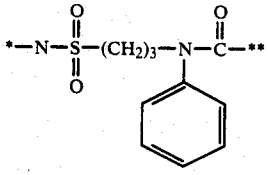
(10)
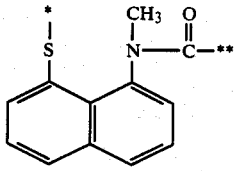
(11)
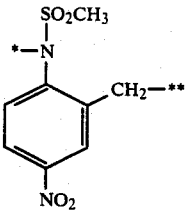
(12)
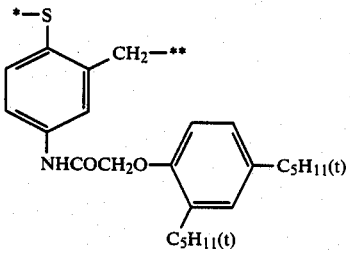
(13)
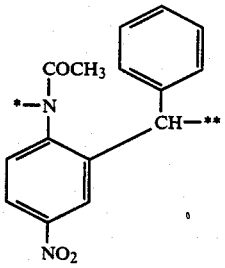
(14)
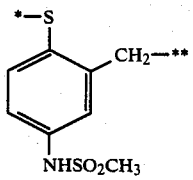
(15)
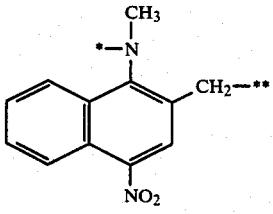

-continued
(16)
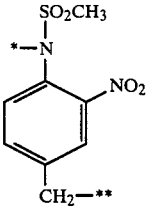
(17)
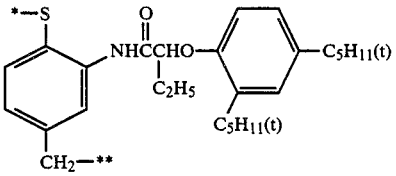
(18)
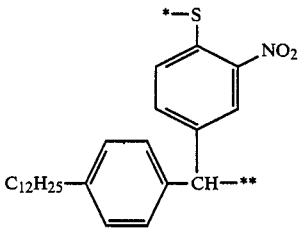
(19)
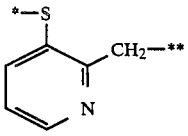
(20)
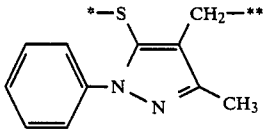
(21)
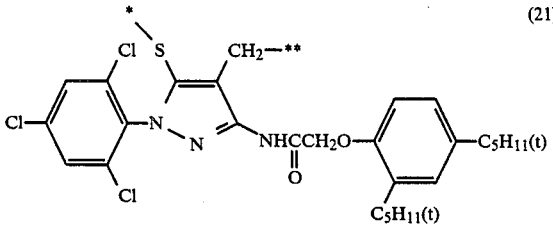
(22)
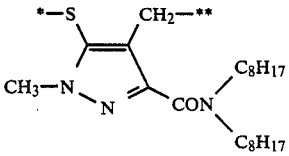
(23)
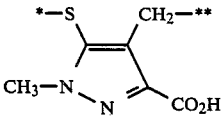
(24)
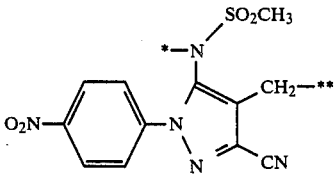
-continued
(25)
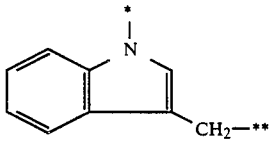
(26)
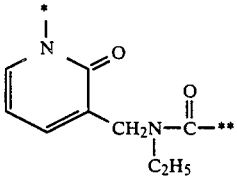
(27)
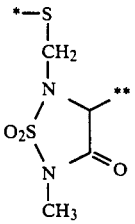
(28)
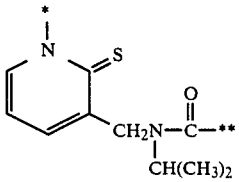
(29)
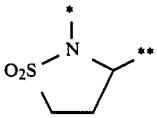
(30)
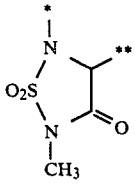
(31)
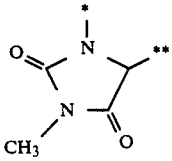
(32)
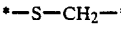
(33)
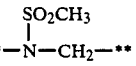
(34)
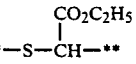
(35)
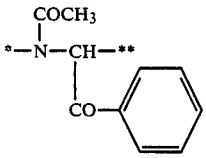

-continued (36)

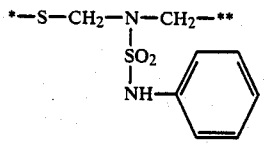

(37)

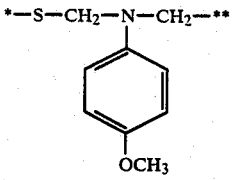

(38)

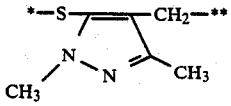

(39)

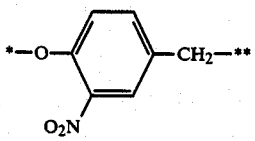

(40)

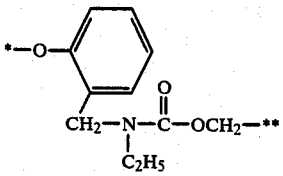

Now, the group represented by the general formula (II) is described in detail below.

R in the general formula (II) represents a straight chain or branched alkylene group (for example, a methylene group, an ethylene group, a propylene group, a butylene group, a hexylene group, a 1-methylethylene group, etc.), a straight chain or branched chain alkenylene group (for example, a vinylene group, a 1-methylvinylene group, etc.), a straight chain or branched chain aralkylene group (for example, a benzylidene group, etc.) or an arylene group (for example, a phenylene group, a naphthylene group, etc.).

The polar substituent represented by Z includes, for example, a substituted or unsubstituted amino group (including the form of a salt; for example, an amino group, hydrochloride of an amino group, a methylamino group, a dimethylamino group, hydrochloride of a dimethylamino group, a dibutylamino group, a dipropylamino group, an N-dimethylaminoethyl-N-methylamino group, etc.), a quaternary ammoniumyl group (for example, a trimethylammoniumyl chloride group, a dimethylbenzylammoniumyl chloride group, etc.), a substituted or unsubstituted alkoxy group (for example, a methoxy group, an ethoxy group, a 2-methoxyethoxy group, etc.), a substituted or unsubstituted aryloxy group (for example, a phenoxy group, etc.), a substituted or unsubstituted alkylthio group (for example, a methylthio group, a butylthio group, a 3-dimethylaminopropylthio group, etc.), a substituted or unsubstituted arylthio group (for example, a phenylthio group, etc.), a substituted or unsubstituted heterocyclic oxy group (for example, a 2-pyridyloxy group, a 2-imidazolyloxy group, etc.), a substituted or unsubstituted heterocyclic thio group (for example, a 2-benzothiazolylthio group, a 4-pyrazolylthio group, etc.), a substituted or unsubstituted sulfonyl group (for example, a methanesulfonyl group, an ethanesulfonyl group, a p-toluenesulfonyl group, etc.), a substituted or unsubstituted carbamoyl group (for example, an unsubstituted carbamoyl group, a methylcarbamoyl group, etc.), a substituted or unsubstituted sulfamoyl group (for example, an unsubstituted sulfamoyl group, a methylsulfamoyl group, etc.), a substituted or unsubstituted carbonamido group (for example, an acetamido group, a benzamido group, etc.), a substituted or unsubstituted sulfonamido group (for example, a methanesulfonamido group, a benzenesulfonamido group, etc.), a substituted or unsubstituted acyloxy group (for example, an acetyloxy group, a benzoyloxy group, etc.), a substituted or unsubstituted ureido group (for example, an unsubstituted ureido group, a methylureido group, an ethylureido group, etc.), a substituted or unsubstituted acyl group (for example, an acetyl group, a benzoyl group, etc.), a substituted or unsubstituted thioureido group (for example, an unsubstituted thioureido group, a methylthioureido group, etc.), a substituted or unsubstituted sulfonyloxy group (for example, a methanesulfonyloxy group, a p-toluenesulfonyloxy group, etc.), a substituted or unsubstituted heterocyclic group (for example, a 1-morpholino group, a 1-piperidino group, a 2-pyridyl group, a 4-pyridyl group, a 2-thienyl group, a 1-pyrazolyl group, a 1-imidazolyl group, a 2-tetrahydrofuryl group, a 2-tetrahydrothienyl group, etc.), a cyano group, a substituted or unsubstituted alkoxycarbonyl group (for example, a methoxycarbonyl group, an ethoxycarbonyl group, etc.), etc.

These polar substituents may be further substituted with one or more substituents including the polar substituents described above.

When Y in the general formula (II) represents

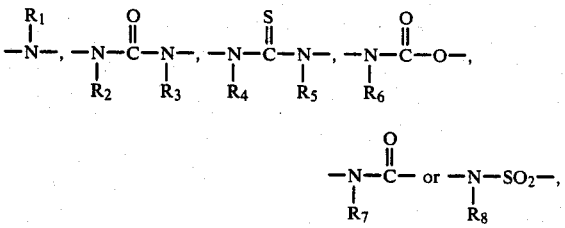

$R_1$, $R_2$, $R_3$, $R_4$, $R_5$, $R_6$, $R_7$ and $R_8$ each represents a hydrogen atom, a substituted or unsubstituted alkyl group (for example, a methyl group, an ethyl group, a propyl group, a 2-dimethylaminoethyl group, etc.), a substituted or unsubstituted aryl group (for example, a phenyl group, a 2-methylphenyl group, etc), a substituted or unsubstituted alkenyl group (for example, a propenyl group, a 1-methylvinyl group, etc.) or a substituted or unsubstituted aralkyl group (for example, a benzyl group, a phenethyl group, etc.).

Of the groups represented by the general formula (II), those wherein R represents a straight chain or branched chain alkylene group, Y represents

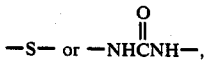

Z represents a substituted or unsubstituted amino group or a substituted or unsubstituted heterocyclic group and n represents 1 are preferred.

In a black-and-white photographic light-sensitive material comprising two or more silver halide emulsion layers, an effect which is similar to an interimage effect which occurs in a color photographic light-sensitive material is also observed in these silver halide emulsion layers.

For instance, in a case wherein a black-and-white photographic light-sensitive material comprises a silver halide emulsion layer of high sensitivity containing silver halide grains having a generally large grain size and a silver halide emulsion layer of low sensitivity containing silver halide grains having a generally small grain size, in an area of a large exposure amount where the low sensitive layer is developed, the high sensitive layer is also developed. When the compound represented by the general formula (I) according to the present invention is incorporated into either the high sensitive silver halide emulsion layer, the low sensitive silver halide emulsion layer or both layers, the development inhibiting action occurs from the low sensitive silver halide emulsion layer to the high sensitive silver halide emulsion layer in the area of a large exposure amount. As a result, an amount of developed silver in the high sensitive silver halide emulsion layer containing silver halide grains having a generally large grain size is reduced and thus graininess in the area of a large exposure amount is improved.

In accordance with the present invention, improvement in sharpness is observed in a color photographic light-sensitive material and a black-and-white photographic light-sensitive material having at least one silver halide emulsion layer.

An intraimage effect occurs within a silver halide emulsion layer simultaneously with the interimage effect occurring between different silver halide emulsion layers. Such an intraimage effect (an edge effect) occurs at an edge between an area of a large exposure amount and an area of a small exposure amount in an individual silver halide emulsion layer.

By means of the incorporation of the compound represented by the general formula (I) according to the present invention into a silver halide emulsion layer, the development inhibiting action occurs from an area of a large exposure amount to an area of a small exposure amount at an edge between these areas. Due to the development inhibiting action at the edge portion, the edge becomes clearer and sharpness is improved.

Specific examples of the compound represented by the general formula (I) used in the present invention are set forth below, but the present invention should not be construed as being limited thereto.

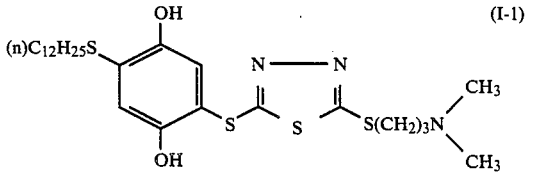
(I-1)

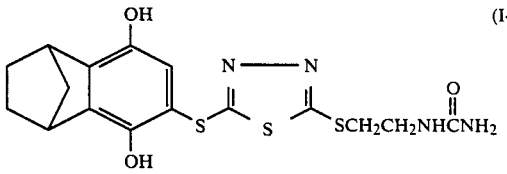
(I-2)

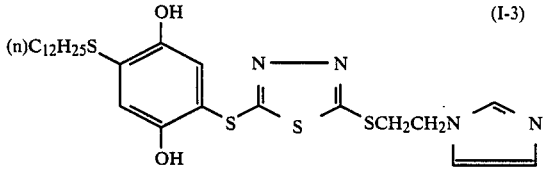
(I-3)

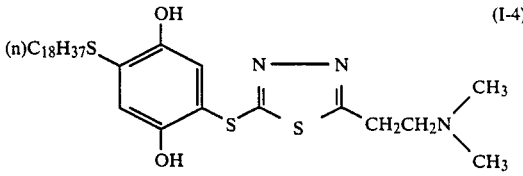
(I-4)

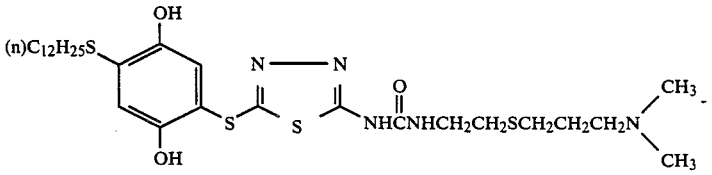
(I-5)

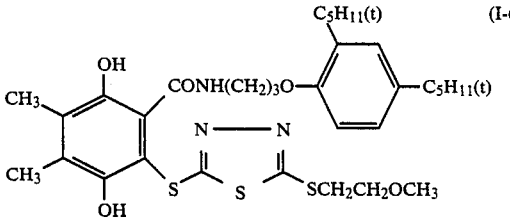
(I-6)

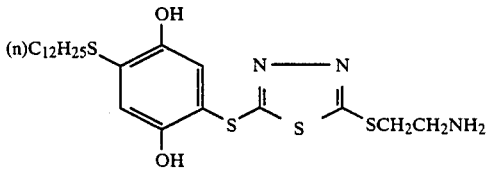
(I-7)

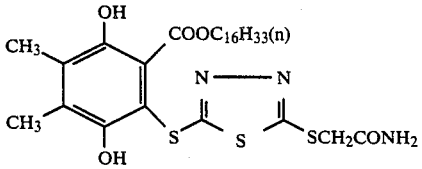
(I-8)

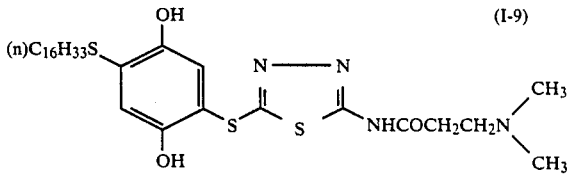
(I-9)

-continued
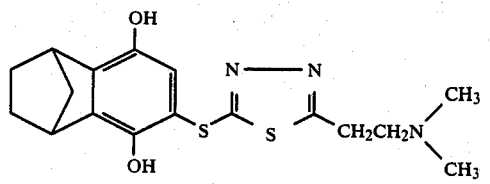
(I-10)
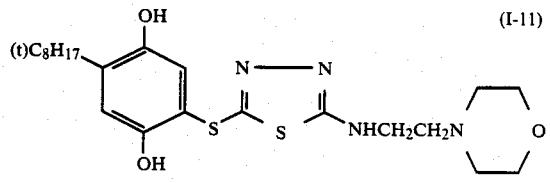
(I-11)
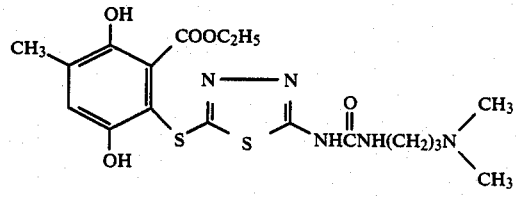
(I-12)
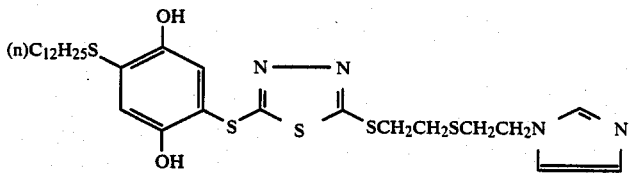
(I-13)
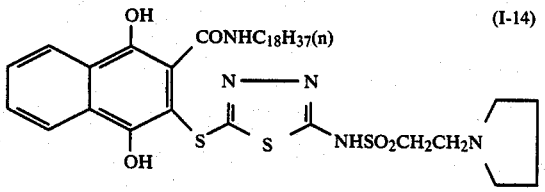
(I-14)
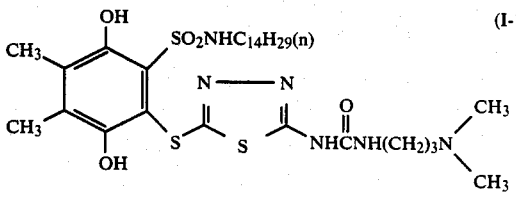
(I-15)
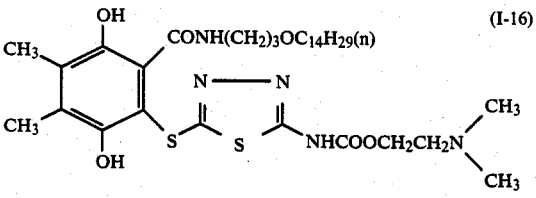
(I-16)
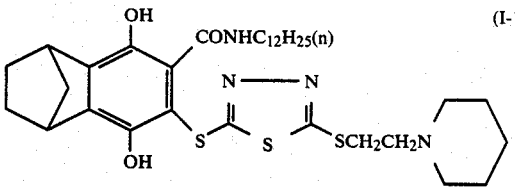
(I-17)
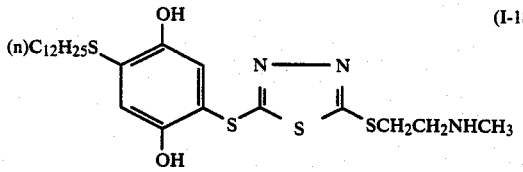
(I-18)
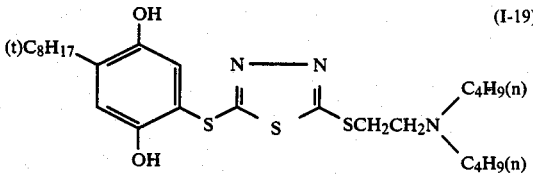
(I-19)
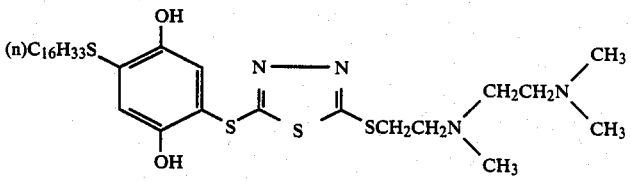
(I-20)
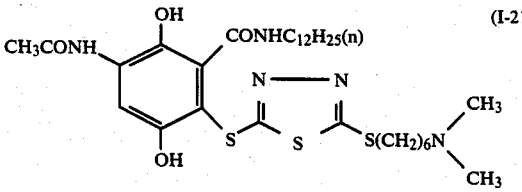
(I-21)
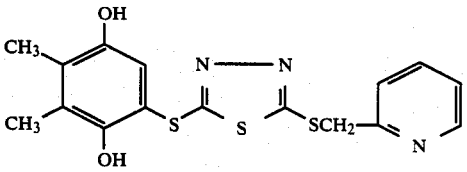
(I-22)

-continued
(I-23)
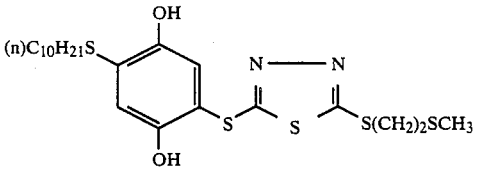
(I-24)
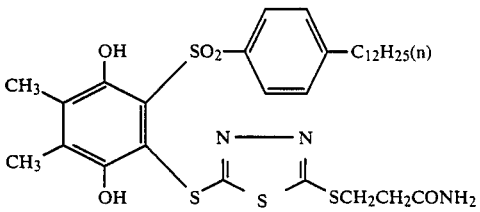
(I-25)
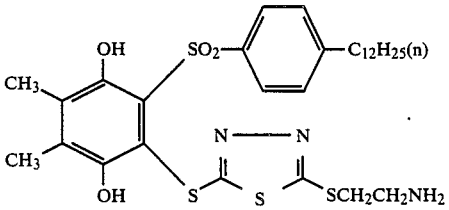
(I-26)
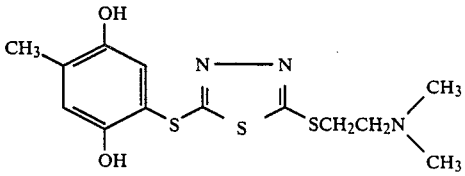
(I-27)
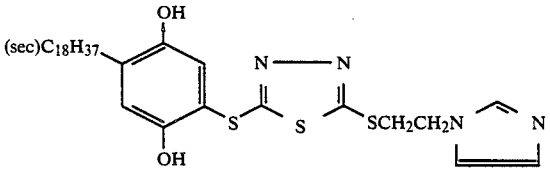
(I-28)
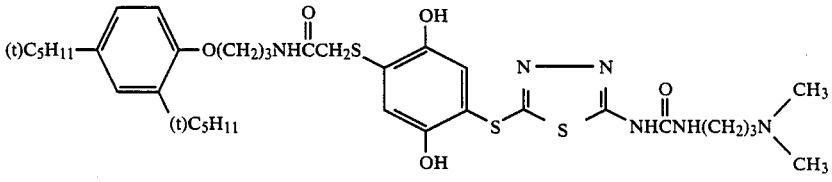
(I-29)
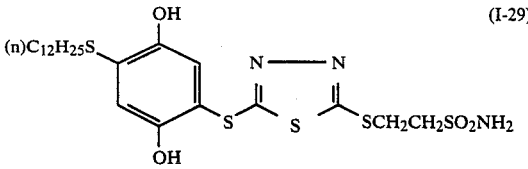
(I-30)
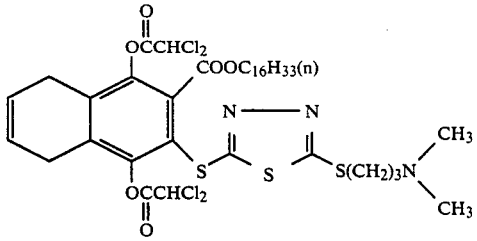
(I-31)
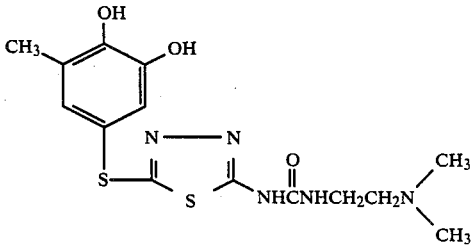
(I-32)
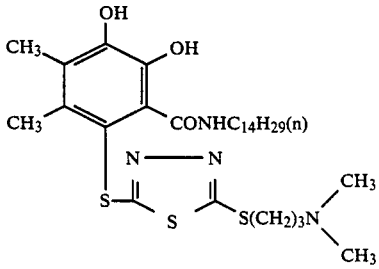
(I-33)
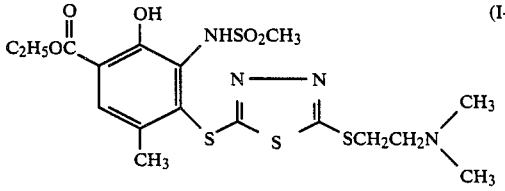
(I-34)
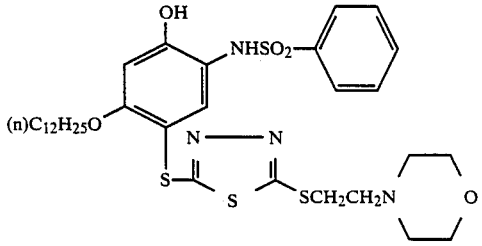

-continued
(I-35)
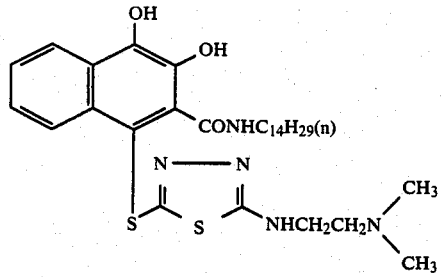
(I-36)
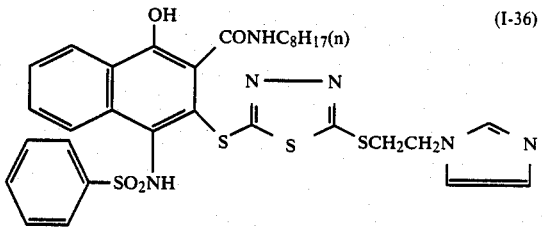
(I-37)
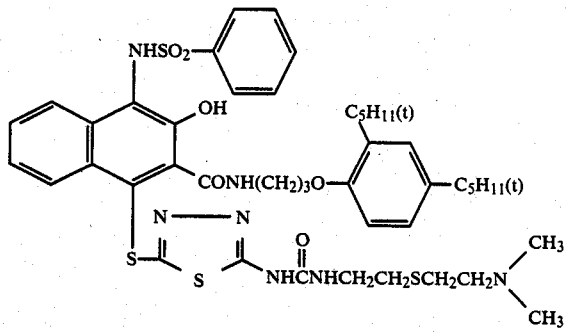
(I-38)
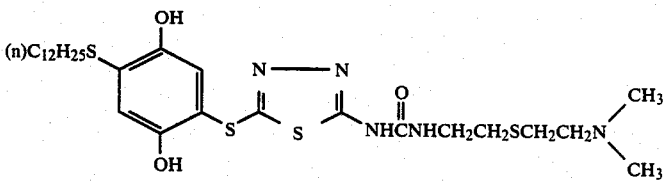
(I-39)
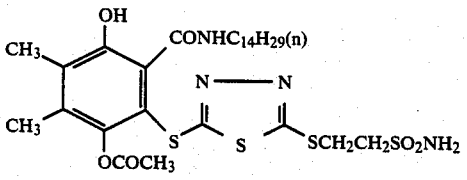
(I-40)
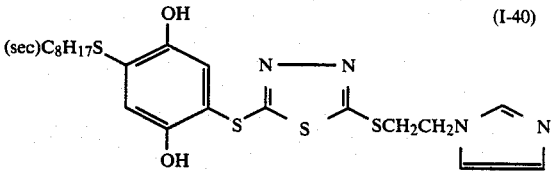
(I-41)
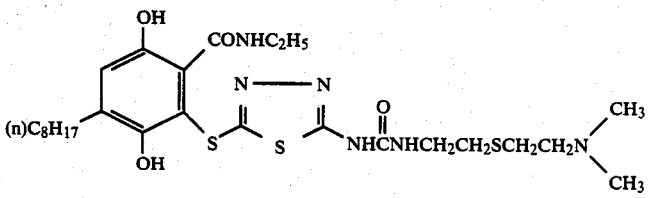
(I-42)
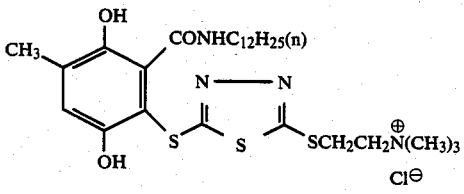
(I-43)
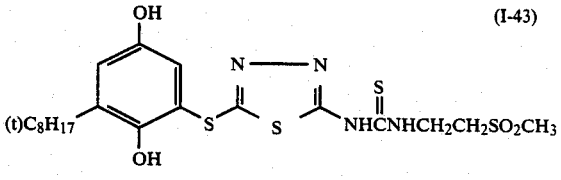
(I-44)
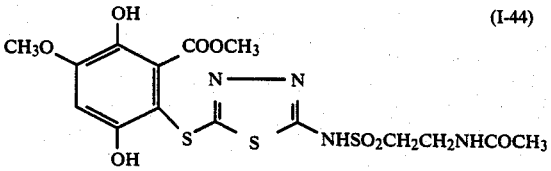
(I-45)
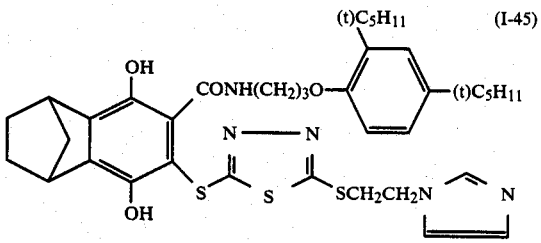

-continued
(I-46)
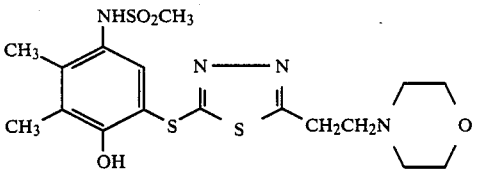
(I-47)
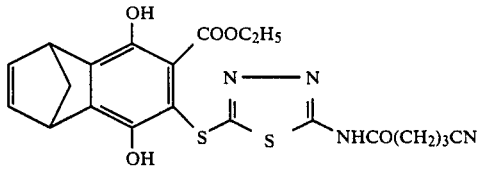
(I-48)
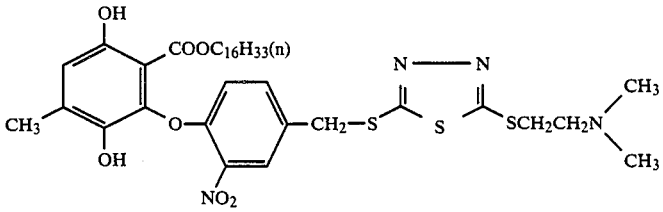
(I-49)
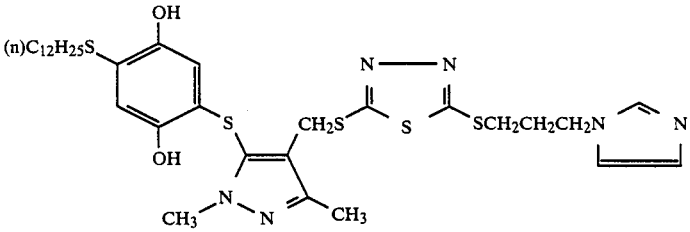
(I-50)
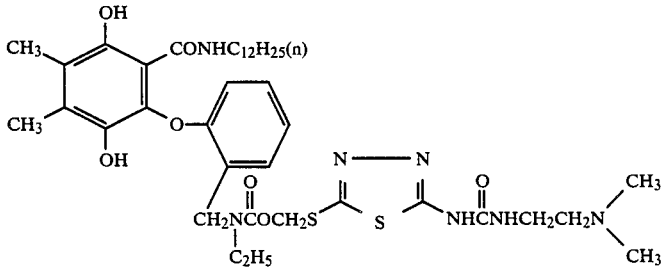
(I-51)
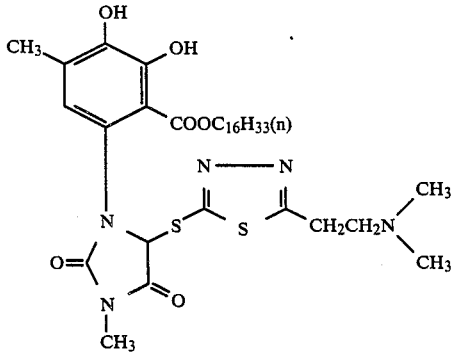
(I-52)
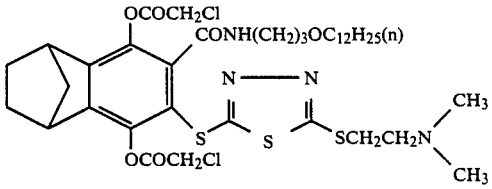
(I-53)
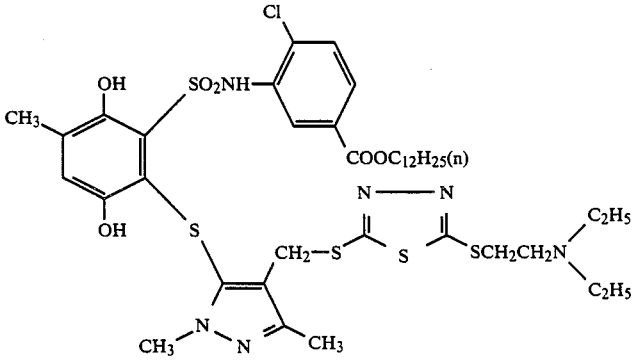

-continued (I-54)

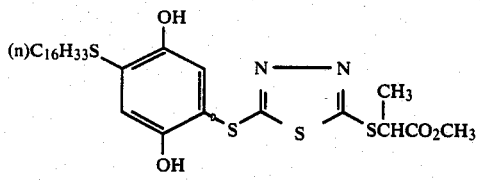

(I-55)

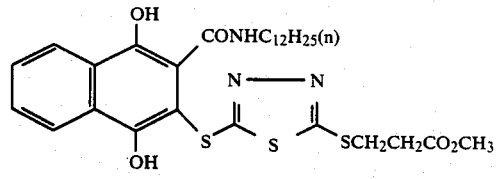

(I-56)

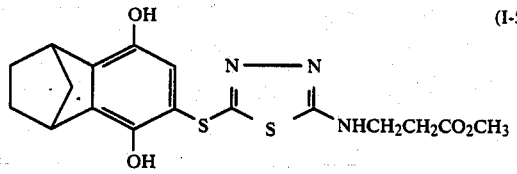

(I-57)

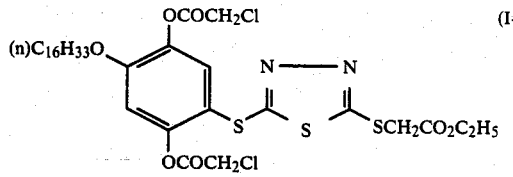

The compounds represented by the general formula (I) can generally by synthesized by the following two methods.

First, in the case that no Time is present (i.e., t=0), the compounds can be synthesized:

(1) by reacting a derivative of benzoquinone, orthoquinone, quinonemonoimine, or quinonediimine with a development inhibitor in chloroform, 1,2-dichloroethane, carbon tetrachloride, or tetrahydrofuran, in the absence of a catalyst or in the presence of an acid catalyst such as p-toluenesulfonic acid, benzenesulfonic acid, trifluoromethanesulfonic acid, or methanesulfonic acid, at a temperature ranging from room temperature to 100° C.; or (2) by reacting a derivative of chlorine-, bromine-, or iodine-substituted benzoquinone, orthoquinone, quinonemonoimine, or quinonediimine with a development inhibitor in a non-protonic polar solvent such as acetone, tetrahydrofuran or dimethylformamide, etc., in the presence of a base such as potassium carbonate, sodium hydrogencarbonate, sodium hydride or triethylamine, etc., at a temperature ranging from −20° C. to 100° C., to obtain a quinone form, and reducing it by a reducing agent such as diethylhydroxylamine or sodium hydrosulfite, such as is described in *Research Disclosure*, No. 18227 (June 1979), and in *Liebigs Ann. Chem.*, 764,131 (1972).

Secondly, in the case of X being released through Time (i.e., t=1), the compounds represented by the general formula (I) can be synthesized in a manner nearly similar to the above. More specifically, the method involves employing Time-X instead of the above-described development inhibitor (X), or preliminarily introducing into the oxidation reduction moiety Time which has a substituent thereon that can be replaced by X, such as a halogen atom, a hydroxyl group, or precursors thereof, and thereafter connecting X by a substitution reaction.

Specific examples of synthesizing the compounds represented by the general formula (I) are shown below. Other compounds used in the present invention can be easily synthesized by analogous methods.

SYNTHESIS EXAMPLE 1

Synthesis of Compound (I-3)

17.5 g of 2-dodecylthiobenzoquinone, 13.9 g of 2-(2-imidazolyl)ethylthio-5-mercapto-1,3,4-thiadiazole and 13.3 g of p-toluenesulfonic acid were added to 100 ml of chloroform and the mixture was refluxed by heating for 5 hours. After the completion of the reaction, 200 ml of n-hexane was added to the reaction solution, then the supernatant liquid was removed by decantation. The residue thus obtained was recrystallized from 250 ml of isopropyl alcohol to obtain 17.6 g (yield: 56%) of the desired compound. Melting Point: 100° to 101° C.

SYNTHESIS EXAMPLE 2

Synthesis of Compound (I-1)

30.8 g of 2-dodecylthiobenzoquinone, 25.9 g of 2-(3-dimethylamino)propylthio-5-mercapto-1,3,4-thiadiazole and 22.4 g of p-toluenesulfonic acid were added to 300 ml of chloroform and the mixture was refluxed by heating for 7 hours. After the completion of the reaction, 500 ml of n-hexane was added to the reaction solution, then the supernatant liquid was removed by decantation. The residue thus obtained was recrystallized from 500 ml of acetonitrile to obtain 38.9 g (yield: 72%) of the desired compound. Melting Point: 153° to 154° C.

SYNTHESIS EXAMPLE 3

Synthesis of Compound (I-45)

3-(1):

Synthesis of
3,6-Dihydroxybenzonorbornene-4-carboxylic Acid 81.8 g of 3,6-dihydroxybenzonorbornene, 260 g of potassium carbonate and 400 ml of dimethylformamide were mixed and the mixture was reacted in an autoclave at 180° C. for 8 hours in contact with carbon dioxide at a pressure of 50 kg/cm$^2$.

After cooling, water was added to the reaction mixture and the resulting solution was acidified with hydrochloric acid. Then, the solution was extracted with ethyl acetate. The organic layer was washed with water and the ethyl acetate was distilled off under a reduced pressure. Warm water was added to the residue and the resulting solution was stirred to obtain 92.1 g (yield: 90.2%) of 3,6-dihydroxybenzonorbornene-4-carboxylic acid as crystals.

3-(2)

Synthesis of
3,6-Dihydroxybenzonorbornene-4-carboxylic Acid
Phenyl Ester

The phenyl ester (oily) was obtained from 3,6-dihydroxybenzonorbornene-4-carboxylic acid by the method as described in Japanese Patent Application (OPI) No. 28139/78.

3-(3)

Synthesis of
3,6-Dihydroxy-4-[3-(2,4-di-tertpentylphenoxy)propylcarbamoyl]benzonorbornene 14.8 g of the phenyl ester synthesized in accordance with 3-(2) was mixed with 14.6 g of 3-(2,4-di-tert-pentylphenoxy)propylamine, the mixture was heated to 140° C. and reacted for 4 hours under a reduced pressure of 20 mm Hg. After cooling, 15.1 g (yield: 61.2%) of 3,6-dihydroxy-4-[3-(2,4-di-tert-pentylphenoxy)propylcarbamoyl]benzonorbornene was obtained by crystallization from n-hexane. Melting Point: 142° C.

3-(4)

Synthesis of
3,6-Dioxo-4-[3-(2,4-di-tert-pentylphenoxy)propylcarbamoyl]-5-chlorobenzonorbornene In 60 ml of tetrahydrofuran was dissolved 4.9 g of the amide obtained in accordance with 3-(3), 2.9 g of N-chlorosuccinimide was added to the solution and then the mixture was reacted for 6 hours at room temperature. Thereafter, the solvent was distilled off, and the residue was purified by silica gel column chromatography to obtain 5.0 g (yield: 95.7%) of 3,6-dioxo-4-[3-(2,4-di-tert-pentylphenoxy)propylcarbamoyl]-5-chlorobenzonorbornene.

3-(5)

Synthesis of Compound (I-45)

1.0 g of potassium carbonate, 2.7 g of 2-(2-imidazolyl-)ethylthio-5-mercapto-1,3,4-thiadiazole and 50 ml of acetone were mixed and the mixture was stirred at room temperature for 30 minutes. Then, to the mixture was added an acetone solution containing 5.3 g of the compound obtained in 3-(4), and the mixture was stirred at room temperature for 3 hours. After the completion of the reaction, the inorganic materials were removed by filtration, and the acetone was distilled off under a reduced pressure. The residue thus obtained was dissolved in 50 ml of ethyl acetate, 55 ml of a 27% aqueous solution of sodium hydrosulfite was added thereto, and the resulting solution was stirred vigorously. After 10 minutes, the reaction solution was subjected to separation, the organic layer was washed with water and then with a saturated aqueous solution of sodium chloride, and thereafter dried with anhydrous sodium sulfate. After the solution was filtered to remove the sodium sulfate, the ethyl acetate was distilled off under a reduced pressure, and the resulting residue was recrystallized from a solvent mixture of ethyl acetate and n-hexane to obtain 6.1 g (yield: 83%) of the desired compound. Melting Point: 143° to 145° C.

SYNTHESIS EXAMPLE 4

Synthesis of Compound (I-28)

4-(1)

Synthesis of
2-[5-(3-Dimethylamino)propylureido-1,3,4-thiadiazol-2-ylthio]-5-methoxycarbonylmethylthiohydroquinone 10.6 g of methoxycarbonylmethylthiobenzoquinone, 14.3 g of 2-(3-dimethylamino)propylureido-5-mercapto-1,3,4-thiadiazole and 10.3 g of p-toluenesulfonic acid were added to 50 ml of chloroform and the mixture was refluxed by heating for 2 hours. After the completion of the reaction, the reaction solution was cooled to room temperature whereby crystals were deposited. The crystals were collected by filtration and washed with 70 ml of water to obtain 15.6 g of 2-[5-(3-dimethylamino)-propylureido-1,3,4-thiadiazol-2-ylthio]-5-methoxycarbonylmethylthiohydroquinone.

4-(2)

Synthesis of Compound (I-28)

14.2 g of the compound obtained in 4-(1) and 9.6 g of 3-(2,4-di-tert-amylphenoxy)propylamine were mixed and the mixture was reacted at 150° C. for 3 hours while distilling off methyl alcohol formed under a reduced pressure. After the completion of the reaction, to the reaction solution were added 70 ml of ethyl acetate and 100 ml of n-hexane whereby crystals were deposited. The crystals were collected by filtration and recrystallized from a solvent mixture of ethyl acetate and n-hexane to obtain 16.3 g (yield: 74%) of the desired compound. Melting Point: 159° to 161° C.

SYNTHESIS EXAMPLE 5

Synthesis of Compound (I-12)

2-Hydroxy-3-methyl-5-formylbenzoic acid was synthesized from 2-hydroxy-3-methylbenzoic acid by the method as described in Japanese Patent Application (OPI) No. 19539/73. 2,5-Dihydroxy-3-methylbenzoic acid was synthesized from the compound in accordance with the method as described in *Organic Synthesis,* Coll. Vol. III, page 759.

Then, 100 g of 2,5-dihydroxy-3-methylbenzoic acid was dissolved in 3 liters of ethanol and refluxed by heating for 8 hours with hydrogen chloride gas bubbled into the solution. After the completion of the reaction, the ethanol was distilled off to obtain the ethyl ester of 2,5-dihydroxy-3-methylbenzoic acid. In 30 ml of ethyl acetate was dissolved 8.0 g of the ester, and the solution was stirred. Then, 12 g of anhydrous sodium sulfate and 23 g of silver oxide were added to the solution, and the inorganic materials were removed by filtration after 30 minutes. To the filtrate was added a solution containing 10.7 g of 2-(3-dimethylamino)propylureido-5-mercapto-1,3,4-thiadiazole and 14.0 g of p-toluenesulfonic acid dissolved in 50 ml of tetrahydrofuran. After being reacted at room temperature for 2 hours, the solvent was distilled off. The residue was subjected to treatment with silica gel column chromatography to separate the main component, which was recrystallized from ethyl alcohol to obtain 7.3 g (yield: 40%) of the desired compound. Melting Point: 167° to 168° C.

SYNTHESIS EXAMPLE 6

Synthesis of Compound (I-5)

15.4 g of 2-dodecylthiobenzoquinone, 19.3 g of 2-[2-(3-dimethylamino)propylthio]ethylureido-5-mercapto-1,3,4-thiadiazole and 12.9 g of p-toluenesulfonic acid were added to 200 ml of chloroform and the mixture was refluxed by heating for 5 hours. After the completion of the reaction, the reaction solution was concentrated under a reduced pressure and the residue was subjected to treatment with silica gel column chromatography to separate the main component, which was recrystallized from a solvent mixture of acetonitrile and methyl alcohol to obtain 17.3 g (yield: 55%) of the desired compound. Melting Point: 142° to 144° C.

The amount of the compound represented by the general formula (I) according to the present invention to be employed is in a range of from $1\times10^{-5}$ to $1\times10^{-1}$ mol, preferably from $1\times10^{-4}$ to $1\times10^{-2}$ mol, per mol of silver halide present in a layer to be added.

The compounds represented by the general formula (I) according to the present invention can be used individually or as a mixture of two or more thereof.

The compounds represented by the general formula (I) according to the present invention can be incorporated into a photographic light-sensitive material in the form of an emulsion obtained by stirring at high speed a solution of the compound dissolved in an oil having a high boiling point in an aqueous medium or in the form of a fine dispersion prepared by dissolving the compound in a water-soluble organic solvent such as in alcohol or a cellosolve, etc., adding the solution to an aqueous gelatin solution and stirring the mixture.

The compounds represented by the general formula (I) according to the present invention can be preferably incorporated into a light-sensitive silver halide emulsion layer.

Further, when the present invention is applied to a black-and-white photographic light-sensitive material, the compound represented by the general formula (I) can be incorporated into a silver halide emulsion layer and/or a protective layer.

The present invention can be applied to any of color photographic light-sensitive materials including, for example, color negative films, color reversal films (including an incorporated coupler type and a coupler-in-developer type), color papers, color positive films, color reversal papers, color photographic light-sensitive materials for a color diffusion transfer process or a dye transfer process, etc., and black-and-white photographic light-sensitive materials including, for example, black-and-white negative films, black-and-white printing papers, X-ray films, lith films, etc.

In order to incorporate couplers into a silver halide emulsion layer in the present invention, known methods including those as described, e.g., in U.S. Pat. No. 2,322,027, can be used. For example, they can be dissolved in a solvent and then dispersed in a hydrophilic colloid. Examples of solvents usable for this process include organic solvents having a high boiling point, such as alkyl esters of phthalic acid (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetyl citrate, etc.), benzoic acid esters (e.g., octyl benzoate, etc.), alkylamides (e.g., diethyllaurylamides, etc.), esters of fatty acids (e.g., dibutoxyethyl succinate, dioctyl azelate, etc.), trimesic acid esters (e.g., tributyl trimesate, etc.), or the like; and organic solvents having a boiling point of from about 30° to about 150° C., such as lower alkyl acetates (e.g., ethyl acetate, butyl acetate, etc.), ethyl propionate, secondary butyl alcohol, methyl isobutyl ketone, β-ethoxyethyl acetate, methyl cellosolve acetate, or the like. Mixtures of organic solvents having a high boiling point and organic solvents having a low boiling point can also be used.

It is also possible to utilize the dispersing method using polymers, as described in Japanese Patent Publication No. 39853/76 and Japanese Patent Application (OPI) No. 59943/76.

Of the couplers, those having an acid group, such as a carboxylic acid group or a sulfonic acid group, can be introduced into hydrophilic colloids as an aqueous alkaline solution.

As the binder or the protective colloid for the photographic emulsion layers or intermediate layers of the photographic light-sensitive material of the present invention, gelatin is advantageously used, but other hydrophilic colloids can be used alone or together with gelatin.

As gelatin in the present invention, not only lime-processed gelatin, but also acid-processed gelatin may be employed. The methods for preparation of gelatin are described in greater detail in Ather Veis, *The Macromolecular Chemistry of Gelatin,* Academic Press (1964).

In the photographic emulsion layer of the photographic light-sensitive material used in the present invention, any of silver bromide, silver iodobromide, silver iodochlorobromide, silver chlorobromide and silver chloride may be used as the silver halide. Particularly, a preferred result can be obtained in a case wherein at least one photographic emulsion layer contains silver chloroiodobromide, silver iodobromide or silver chloroiodide each having an iodide content of 0.5 to 15 mol%.

Although the mean grain size of silver halide particles in the photographic emulsion (the mean grain size being determined with the grain diameter in those particles which are spherical or nearly spherical, and the edge length in those particles which are cubic, and being expressed as a mean value calculated from projected areas) is not particularly limited, it is preferably 3 μm or less.

The distribution of grain size may be broad or narrow.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures may be used.

Further, the photographic emulsion wherein at least 50% of the total projected area of silver halide particles is super tabular silver halide particles having a diameter at least five times their thickness may be employed.

The inner portion and the surface layer of silver halide particles may be different in phase. Silver halide particles may be those in which a latent image is formed mainly on the surface thereof, or those in which a latent image is formed mainly in the interior thereof.

The photographic emulsion used in the present invention can be prepared in any suitable manner, e.g., by the method as described in P. Glafkides, *Chimie et Physique Photographique,* Paul Montel (1967), G. F. Duffin, *Photographic Emulsion Chemistry,* The Focal Press (1966), and V. L. Zelikman et al., *Making and Coating Photographic Emulsion,* The Focal Press (1964). That is, any of an acid process, a neutral process, an ammonia process, etc., can be employed.

Soluble silver salts and soluble halogen salts can be reacted by techniques such as a single jet process, a double jet process, and a combination thereof. In addition, there can be employed a method (so-called reversal mixing process) in which silver halide particles are formed in the presence of an excess of silver ions.

As one system of the double jet process, a so-called controlled double jet process in which the pAg in the liquid phase where silver halide is formed is maintained at a predetermined level can be employed. This process can produce a silver halide emulsion in which the crystal form is regular and the grain size is nearly uniform.

Two or more kinds of silver halide emulsions which are prepared separately may be used as a mixture.

The formation of physical ripening of silver halide particles may be carried out in the presence of cadmium salts, zinc salts, lead salts, thallium salts, iridium salts or its complex salts, rhodium salts or its complex salts, iron salts or its complex salts, and the like.

Silver halide emulsions are usually chemically sensitized. For this chemical sensitization, for example, the methods as described in H. Frieser ed., *Die Grundlagen der Photographischen Prozesse mit Silberhalogeniden,* Akademische Verlagsgesellschaft, pages 675 to 734 (1968) can be used. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid, and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other.

The photographic emulsion used in the present invention may include various compounds for the purpose of preventing fog formation or of stabilizing photographic performance in the photographic light-sensitive material during the production, storage or photographic processing thereof. For example, those compounds known as antifoggants or stabilizers can be incorporated, including azoles such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly 1-phenyl-5-mercaptotetrazole), etc.; mercaptopyrimidines; mercaptotriazines; thioketo compounds such as oxazolinethione, etc.; azaindenes such as triazaindenes, tetraazaindenes (particulary 4-hydroxy-substituted (1,3,3a,7)tetraazaindenes), pentaazaindenes, etc.; benzenethiosulfonic acids; benzenesulfinic acids; benzenesulfonic amides; etc.

In the photographic emulsion layers or other hydrophilic colloid layers of the photographic light-sensitive material of the present invention can be incorporated various surface active agents as coating aids or for other various purposes, e.g., prevention of charging, improvement of slipping properties, acceleration of emulsification and dispersion, prevention of adhesion, and improvement of photographic characteristics (for example, development acceleration, high contrast, and sensitization), etc.

The photographic emulsion layer of the photographic light-sensitive material of the present invention may contain compounds such as polyalkylene oxide or its ether, ester, amine or like derivatives, thioether compounds, thiomorpholines, quaternary ammonium salt compounds, urethane derivatives, urea derivatives, imidazole derivatives, and 3-pyrazolidones for the purpose of increasing sensitivity and contrast or of accelerating development.

In the photographic emulsion layer or other hydrophilic colloid layers of the photographic light-sensitive material of the present invention can be incorporated water-insoluble or sparingly soluble synthetic polymer dispersions for the purpose of improving dimensional stability, etc. Synthetic polymers which can be used include homo- or copolymers of alkyl acrylate or methacrylate, alkoxyalkyl acrylate or methacrylate, glycidyl acrylate or methacrylate, acrylamide or methacrylamide, vinyl esters (e.g., vinyl acetate), acrylonitrile, olefins, styrene, etc., and copolymers of the foregoing monomers and acrylic acid, methacrylic acid, $\alpha,\beta$-unsaturated dicarboxylic acid, hydroxyalkyl acrylate or methacrylate, sulfoalkyl acrylate or methacrylate, and styrenesulfonic acid, etc.

The photographic emulsion used in the present invention can also be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes ad the complex merocyanine dyes that can be employed contain 5- or 6-membered heterocyclic nuclei having a ketomethylene structure such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present.

The present invention is also applicable to a multilayer multicolor photographic material containing layers sensitive to at least two different spectral wavelength ranges on a support. A multilayer natural color photographic material generally possesses at least one red-sensitive silver halide emulsion layer, at least one green-sensitive silver halide emulsion layer and at least one blue-sensitive silver halide emulsion layer, respectively, on a support. The order of these layers can be varied, if desired. Ordinarily, a cyan-forming coupler is present in a red-sensitive emulsion layer, a magenta-forming coupler is present in a green-sensitive emulsion layer and a yellow-forming coupler is present in a blue-sensitive emulsion layer, respectively. However, if desired, a different combination can be employed.

In the same or different photographic emulsion layers or light-insensitive layers of the photographic light-sensitive material of the present invention can be incorporated, in addition to the compounds according to the present invention described above, other dye-forming couplers, i.e., compounds capable of forming color upon oxidative coupling with aromatic primary amine developing agents (e.g., phenylenediamine derivatives, aminophenol derivatives, etc.) during the course of color development processing. Examples of such couplers include magenta couplers, such as 5-pyrazolone couplers, pyrazolobenzimidazole couplers, pyrazoloimidazole couplers, pyrazolopyrazole couplers, pyrazolotriazole couplers, pyrazolotetrazole couplers, cyanoacetyl coumarone couplers and open chain acylacetonitrile couplers, etc.; yellow couplers, such as acylacetamide couplers (e.g., benzoylacetanilides, pivaloylacetanilides, etc.), etc.; and cyan couplers, such as naphthol couplers, phenol couplers, etc. It is preferable to use nondiffusible couplers containing a hydrophobic group (a so-called ballast group) with the molecule or polymeric couplers. They may be either 4-equivalent or 2-equivalent with respect to silver ions. It is also possible to use colored couplers capable of exerting color correction effects, or couplers capable of releasing development inhibitors during the course of development (so-called DIR couplers).

Further, the emulsion layer may contain non-color-forming DIR coupling compounds which release a development inhibitor, the product of which formed by a coupling reacton is colorless, other than DIR couplers.

Two or more kinds of the compounds according to the present invention and the above-described couplers and the like can be incorporated together in the same layer for the purpose of satisfying the properties required of the photographic light-sensitive material, or the same compound can naturally be added to two or more layers.

The photographic light-sensitive material of the present invention may contain inorganic or organic hardeners in the photographic emulsion layer and other hydrophilic colloid layers thereof. For example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, etc.), active halogen compounds (e.g., 2,4-dichloro-6-hydroxy-s-triazine, etc.), and mucohalogenic acids (e.g., mucochloric acid, mucophenoxychloric acid, etc.) can be used alone or in combination with each other.

In the photographic light-sensitive material of the present invention, when dyes, ultraviolet ray absorbing agents, and the like are incorporated in the hydrophilic colloid layers, they may be mordanted with cationic polymers, etc.

The photographic light-sensitive material of the present invention may contain therein hydroquinone derivatives, aminophenol derivatives, gallic acid derivatives, ascorbic acid derivatives, etc., as color fog preventing agents.

The hydrophilic colloid layers of the photographic light-sensitive material of the present invention can contain ultraviolet ray absorbing agents. For example, benzotriazole compounds substituted with aryl groups (e.g., those as described in U.S. Pat. No. 3,533,794), 4-thiazolidone compounds (e.g., those as described in U.S. Pat. Nos. 3,314,794 and 3,352,681), benzophenone compounds (e.g., those as described in Japanese Patent Application (OPI) No. 2784/71), cinnamic acid ester compounds (e.g., those as described in U.S. Pat. Nos. 3,705,805 and 3,707,375), butadiene compounds (e.g., those as described in U.S. Pat. No. 4,045,229) or benzoxazole compounds (e.g., those as described in U.S. Pat. No. 3,700,455) can be employed. Ultraviolet ray absorbing couplers (e.g., α-naphthol type cyan dyeforming couplers) and ultraviolet ray absorbing polymers can also be employed. These ultraviolet ray absorbing agents can also be mordanted in a specific layer(s), if desired.

The photographic light-sensitive material of the present invention may contain water-soluble dyes in the hydrophilic colloid layers thereof as filter dyes or for various purposes, e.g., irradiation prevention. Examples of such dyes include oxonol dyes, hemioxonol dyes, styryl dyes, merocyanine dyes, cyanine dyes, and azo dyes. In particular, oxonol dyes, hemioxonol dyes, and merocyanine dyes are useful.

In carrying out the present invention, known color fading preventing agents can be used together. Color image stabilizers can be used alone or in combination with each other. Typical known color fading preventing agents include hydroquinone derivatives, gallic acid derivatives, p-alkoxyphenols, p-oxyphenol derivatives, bisphenols, etc.

The typical examples of suitable supports to be used in the present invention are described, for example, in *Research Disclosure,* No. 176643, page 28 and No. 18716, page 647, right column to page 648, left column.

In photographic processing of layers composed of photographic emulsions in the photographic light-sensitive material of the present invention, any of known procedures and known processing solutions, e.g., those as described in *Research Disclosure,* No. 176, pages 28 to 30 can be used. The processing temperature is usually selected from between 18° C. and 50° C., although it may be lower than 18° C. or higher than 50° C.

When the silver halide photographic material of the present invention is a black-and-white photographic light-sensitive material, a black-and-white development step and a fixing step are carried out. In the case of a color photographic light-sensitive material, a color development step, a bleaching step and a fixing step are carried out. Further, in the case of a color reversal photographic light-sensitive material, a black-and-white development step, a reversal step, a color development step, a bleaching step and a fixing step are carried out.

In the first developing solution used in the present invention, any known developing agents can be used, including dihydroxybenzenes (e.g., hydroquinone), 3-pyrazolidones (e.g., 1-phenyl-3-pyrazolidone), aminophenols (e.g., N-methyl-p-aminophenol), 1-phenyl-3-pyrazolines, ascorbic acid, heterocyclic compounds wherein a 1,2,3,4-tetrahydroquinoline ring is fused to an indolenine ring as described in U.S. Pat. No. 4,067,872, and the like, which can be used alone or in combination.

The black-and-white developing solution used in the present invention may contain, if desired, conventionally used preservatives (e.g., sulfites or bisulfites, etc.), buffering agents (e.g., carbonates, borates, boric acid or alkanolamines, etc.), alkali agents (e.g., hydroxides or carbonates, etc.), dissolution aids (e.g., polyethylene glycols or esters thereof, etc.), pH controlling agents (e.g., organic acids such as acetic acid, etc.), sensitizers (e.g., quaternary ammonium salts, etc.), development accelerators, surface active agents, toning agents, defoaming agents, hardeners or viscosity imparting agents.

In the first developing solution used in the present invention, a compound which functions as a silver halide solvent should be incorporated. Usually, the above-described sulfites added as preservatives also act as the solvent. Specific examples of the sulfites and other silver halide solvents which can be used include KSCN, NaSCN, $K_2SO_3$, $Na_2SO_3$, $K_2S_2O_5$, $Na_2S_2O_5$, $K_2S_2O_3$ and $Na_2S_2O_3$, etc.

In order to accelerate the development, a development accelerator is used. Particularly, compounds represented by the general formula (A) shown below as described in Japanese Patent Application (OPI) No. 63580/82 are used alone or in combination, and the above-described silver halide solvents may be used together with them.

$$R_{12}S-(R_{11})_dS-R_{12} \quad (A)$$

wherein $R_{11}$ represents an alkylene group having from 2 to 10 carbon atoms which may contain an ether bond; $R_{12}$ represents an alkyl group having from 2 to 10 carbon atoms which may have a substituent or may contain an ether bond or an ester bond; and d represents an integer of from 0 to 3.

Although a suitable amount of these silver halide solvents should be used because too small an amount causes delay of development and too large an amount causes fogging on the silver halide emulsion, a suitable amount can be easily determined by persons skilled in the art.

For example, it is preferred to use $SCN^-$ in a range of from 0.005 to 0.02 mol, particularly from 0.01 to 0.015 mol, and $SO_3^{3-}$ in a range of from 0.05 to 1 mol, particularly from 0.1 to 0.5 mol, per liter of the developing solution.

When the compound represented by the general formula (A) is added to the black-and-white developing solution used in the present invention, the amount thereof is preferred to be in a range of from $5\times10^{-6}$ mol to $5\times10^{-1}$ mol, more preferably from $1\times10^{-4}$ mol to $2\times10^{-1}$ mol, per liter of the developing solution.

The pH of the developing solution prepared as described above is selected so as to give the desired density and contrast, but it is preferred to be in a range of from about 8.5 to about 11.5.

In order to carry out sensitization processing with the first developing solution, the processing time is extended to at most about 3 times the standard processing time. In this case, when the processing temperature is raised, a prolonged processing time for the sensitization processing can be shortened.

The fogging bath used in the reversal step may contain known fogging agents, including stannous ion complex salts such as a stannous ion-organophosphoric acid complex salt (as described in U.S. Pat. No. 3,617,282), a stannous ion-organic phosphonocarboxylic acid complex salt (as described in Japanese Patent Publication No. 32616/81), and a stannous ion-aminopolycarboxylic acid complex salt (as described in British Pat. No. 1,209,050), etc., and boron compounds such as boron hydride compounds (as described in U.S. Pat. No. 2,984,567) and heterocyclic amine borane compounds (as described in British Pat. No. 1,011,000), etc. The fogging bath (reversal bath) can vary in pH over a wide range from acid to alkaline, i.e., in a range of 2 to 12, preferably 2.5 to 10, more preferably 3 to 9.

The color developing solution used in the present invention is a conventional color developing solution containing an aromatic primary amine developing agent. Preferred examples of the aromatic primary amine color developing agents are p-phenylenediamine derivatives, including, e.g., N,N-diethyl-p-phenylenediamine, 2-amino-5-diethylaminotoluene, 2-amino-5-(N-ethyl-N-laurylamino)toluene, 4-[N-ethyl-N-(β-hydroxyethyl)amino]aniline, 2-methyl-4-[N-ethyl-N-(β-hydroxyethyl)amino]aniline, N-ethyl-N-(β-methanesulfonamidoethyl)-3-methyl-4-aminoaniline, N-(2-amino-5-diethylaminophenylethyl)methanesulfonamide, N,N-dimethyl-p-phenylenediamine, and 4-amino-3-methyl-N-ethyl-N-methoxyethylaniline, 4-amino-3-methyl-N-ethyl-N-β-ethoxyethylaniline and 4-amino-3-methyl-N-ethyl-N-β-butoxyethylaniline as described in U.S. Pat. Nos. 3,656,950 and 3,698,525 and salts thereof (e.g., sulfates, hydrochlorides, sulfites, p-toluenesulfonates, etc.).

The color developing solution may further contain other compounds conventionally used as components of developing solutions. For example, as alkali agents and buffering agents, sodium hydroxide, potassium hydroxide, sodium carbonate, potassium carbonate, sodium tertiary phosphate or potassium tertiary phosphate, potassium metaborate and borax can be used alone or in combination.

To the color developing solution, sulfites (e.g., sodium sulfite, potassium sulfite, potassium bisulfite and sodium bisulfite, etc.) or hydroxylamine, which are generally used as preservatives, can be added. Any development accelerators can be added to the color developing solution, if desired. For example, it is possible to use various pyridinium compounds and other cationic compounds as described in U.S. Pat. No. 2,648,604, Japanese Patent Publication No. 9503/69 and U.S. Pat. No. 3,671,247, cationic dyes such as phenosafranine, neutral salts such as thallium nitrate or potassium nitrate, nonionic compounds such as polyethylene glycol or derivatives thereof or polythioethers, as described in Japanese Patent Publication No. 9504/69 and U.S. Pat. Nos. 2,533,990, 2,531,832, 2,950,970 and 2,577,127, organic solvents or organic amines as described in Japanese Patent Publication No. 9509/69 and Belgian Pat. No. 682,862, ethanolamine, ethylenediamine diethanolamine, and accelerators as described in L. F. A. Mason, *Photographic Processing Chemistry,* pages 40 to 43 (Focal Press, London, 1966).

The color developing solution may contain aminopolycarboxylic acids, such as ethylenediaminetetraacetic acid, nitrilotriacetic acid, cyclohexanediaminetetraacetic acid, iminodiacetic acid, N-hydroxymethylethylenediaminetriacetic acid and diethylenetriaminepentaacetic acid, as water softeners.

To the color developing solution, competing couplers or compensating developing agents can be added.

As the competing couplers, citrazinic acid, J-acid or H-acid, etc., is useful.

As the compensating developing agents, p-aminophenol, N-benzyl-p-aminophenol or 1-phenyl-3-pyrazolidone, etc., can be used.

The pH of the color developing solution is preferred to be in a range of from about 8 to about 13. The temperature of the color developing solution is selected between about 20° C. and 70° C., but is preferably between 30° C. and 60° C.

The photographic emulsion layers after color development are usually bleached. Bleach processing may be carried out simultaneously with or separately from fixation processing. As bleaching agents, compounds of polyvalent metals, such as iron (III), cobalt (III), chromium (VI), copper (II), etc., peracids, quinones or nitroso compounds, are used. For example, it is possible to use ferricyanides, bichromates, organic complex salts of iron (III) or cobalt (III) such as complex salts of aminopolycarboxylic acids, e.g., ethylenediaminetetraacetic acid, nitrilotriacetic acid or 1,3-diamino-2-propanoltetraacetic acid, etc., or organic acids, e.g., citric acid, tartaric acid, or malic acid, etc.; persulfates and permanganates; and nitrosophenol. Of these compounds, potassium ferricyanide, sodium iron (III) ethylenediaminetetraacetate and ammonium iron (III) ethylenediaminetetraacetate are particularly useful. Iron (III) aminopolycarboxylate complex salts are useful in both an independent bleaching solution and a monobath bleach-fixing solution.

Various additives including bleach accelerators as described in U.S. Pat. Nos. 3,042,520 and 3,241,966 and Japanese Patent Publication Nos. 8506/70 and 8836/70, etc., can be added to the bleaching or bleach-fixing solution.

The fixing bath used in the present invention contains a fixing agent such as ammonium, sodium or potassium thiosulfate in an amount of from about 30 g/l to about 200 g/l and can additionally contain stabilizers such as sulfites, metabisulfites, etc., hardeners such as potassium alum, etc., pH buffers such as acetates, borates, phosphates, carbonates, etc., and the like. The pH of the fixing solution ranges from 3 to 10, preferably from 5 to 9.

The present invention will be explained in greater detail with reference to the following examples, but the present invention should not be construed as being limited thereto.

EXAMPLE 1

The layers each having the composition shown below were coated on a cellulose triacetate film support in order, to prepare a multilayer color photographic light-sensitive material which was designated Sample 119.

| | |
|---|---|
| **First Layer: Antihalation Layer** | |
| Gelatin layer containing: | |
| Black colloidal silver | 0.18 g/m$^2$ |
| **Second Layer: Intermediate Layer** | |
| Gelatin layer containing: | |
| 2,5-Di-tert-pentadecylhydroquinone | 0.18 g/m$^2$ |
| Coupler C-3 | 0.11 g/m$^2$ |
| **Third Layer: First Red-Sensitive Emulsion Layer** | |
| Gelatin layer containing: | |
| Silver iodobromide emulsion (silver iodide: 4 mol %, average particle size: 0.4 μm) | 0.72 g/m$^2$ (this amount indicates hereinbelow the coated silver amount) |
| Sensitizing Dye A | $9.0 \times 10^{-5}$ mol/mol of silver |
| Sensitizing Dye B | $3.0 \times 10^{-5}$ mol/mol of silver |
| Sensitizing Dye C | $4.2 \times 10^{-4}$ mol/mol of silver |
| Sensitizing Dye D | $3.0 \times 10^{-5}$ mol/mol of silver |
| Coupler C-4 | 0.093 g/m$^2$ |
| Coupler C-5 | 0.31 g/m$^2$ |
| Coupler C-6 | 0.01 g/m$^2$ |
| **Fourth Layer: Second Red-Sensitive Emulsion Layer** | |
| Gelatin layer containing: | |
| Silver iodobromide emulsion (silver iodide: 10 mol %, average particle size: 1.0 μm) | 1.2 g/m$^2$ |
| Sensitizing Dye A | $7.8 \times 10^{-5}$ mol/mol of silver |
| Sensitizing Dye B | $2.2 \times 10^{-5}$ mol/mol of silver |
| Sensitizing Dye C | $3.0 \times 10^{-4}$ mol/mol of silver |
| Sensitizing Dye D | $2.2 \times 10^{-5}$ mol/mol of silver |
| Coupler C-4 | 0.1 g/m$^2$ |
| Coupler C-5 | 0.061 g/m$^2$ |
| Coupler C-7 | 0.046 g/m$^2$ |
| **Fifth Layer: Third Red-Sensitive Emulsion Layer** | |
| Gelatin layer containing: | |
| Silver iodobromide emulsion (silver iodide: 10 mol %, average particle size: 1.5 μm) | 1.5 g/m$^2$ |
| Sensitizing Dye A | $8.0 \times 10^{-5}$ mol/mol of silver |
| Sensitizing Dye B | $2.4 \times 10^{-5}$ mol/mol of silver |
| Sensitizing Dye C | $3.3 \times 10^{-5}$ mol/mol of silver |
| Sensitizing Dye D | $2.4 \times 10^{-5}$ mol/mol of silver |
| Coupler C-7 | 0.32 g/m$^2$ |
| Coupler C-17 | 0.001 g/m$^2$ |
| **Sixth Layer: Intermediate Layer** | |
| Gelatin layer | |
| **Seventh Layer: First Green-Sensitive Emulsion Layer** | |
| Gelatin layer containing: | |
| Silver iodobromide emulsion (silver iodide: 5 mol %, average particle size: 0.5 μm) | 0.55 g/m$^2$ |
| Sensitizing Dye G | $3.8 \times 10^{-4}$ mol/mol of silver |
| Sensitizing Dye E | $1.5 \times 10^{-4}$ mol/mol of silver |
| Coupler C-8 | 0.29 g/m$^2$ |
| Coupler C-3 | 0.04 g/m$^2$ |
| Coupler C-10 | 0.055 g/m$^2$ |
| Coupler C-11 | 0.058 g/m$^2$ |
| **Eighth Layer: Second Green-Sensitive Emulsion Layer** | |
| Gelatin layer containing: | |
| Silver iodobromide emulsion (silver iodide: 6 mol %, average particle size: 1.2 μm, spherical particles) | 1.0 g/m$^2$ |
| Sensitizing Dye G | $2.7 \times 10^{-4}$ mol/mol of silver |
| Sensitizing Dye E | $1.1 \times 10^{-4}$ mol/mol of silver |
| Coupler C-8 | 0.25 g/m$^2$ |
| Coupler C-3 | 0.013 g/m$^2$ |
| Coupler C-10 | 0.009 g/m$^2$ |
| Coupler C-11 | 0.011 g/m$^2$ |
| **Ninth Layer: Third Green-Sensitive Emulsion Layer** | |
| Gelatin layer containing: | |
| Silver iodobromide emulsion (silver iodide: 8 mol %, average particle size: 1.8 μm, spherical particles) | 2.0 g/m$^2$ |
| Sensitizing Dye G | $3.0 \times 10^{-4}$ mol/mol of silver |
| Sensitizing Dye E | $1.2 \times 10^{-4}$ mol/mol of silver |

-continued

| | |
|---|---|
| Coupler C-3 | 0.008 g/m$^2$ |
| Coupler C-12 | 0.05 g/m$^2$ |
| Coupler C-18 | 0.001 g/m$^2$ |
| Tenth Layer: Yellow Filter Layer | |
| Gelatin layer containing: | |
| Yellow colloidal silver | 0.04 g/m$^2$ |
| 2,5-Di-tert-pentadecylhydroquinone | 0.031 g/m$^2$ |
| Eleventh Layer: First Blue-Sensitive Emulsion Layer | |
| Gelatin layer containing: | |
| Silver iodobromide emulsion (silver iodide: 5 mol %, average particle size: 0.4 μm) | 0.32 g/m$^2$ |
| Coupler C-13 | 0.68 g/m$^2$ |
| Coupler C-14 | 0.03 g/m$^2$ |
| Coupler C-19 | 0.015 g/m$^2$ |
| Twelfth Layer: Second Blue-Sensitive Emulsion Layer | |
| Gelatin layer containing: | |
| Silver iodobromide emulsion (silver iodide: 10 mol %, average particle size: 1.0 μm) | 0.29 g/m$^2$ |
| Sensitizing Dye F | 2.2 × 10$^{-4}$ mol/mol of silver |
| Coupler C-13 | 0.22 g/m$^2$ |
| Thirteenth Layer: Fine Particle Emulsion Layer | |
| Gelatin layer containing: | |
| Silver iodobromide emulsion (silver iodide: 2 mol %, average particle size: 0.15 μm) | 0.4 g/m$^2$ |
| Fourteenth Layer: Third Blue-Sensitive Emulsion Layer | |
| Gelatin layer containing: | |
| Silver iodobromide emulsion (silver iodide: 14 mol %, average particle size: 2.3 μm) | 0.79 g/m$^2$ |
| Sensitizing Dye F | 2.3 × 10$^{-4}$ mol/mol of silver |
| Coupler C-13 | 0.19 g/m$^2$ |
| Coupler C-15 | 0.001 g/m$^2$ |
| Fifteenth Layer: First Protective Layer | |
| Gelatin layer containing: | |
| Ultraviolet Ray Absorbing Agent C-1 | 0.14 g/m$^2$ |
| Ultraviolet Ray Absorbing Agent C-2 | 0.22 g/m$^2$ |
| Sixteenth Layer: Second Protective Layer | |
| Gelatin layer containing: | |
| Polymethyl methacrylate particles (diameter: 1.5 μm) | 0.05 g/m$^2$ |
| Silver iodobromide emulsion (silver iodide: 2 mol %, average particle size: 0.07 μm) | 0.3 g/m$^2$ |

In each of the above layers, Gelatin Hardener C-16 and a surface active agent were further incorporated in addition to the above-described components.

Compounds used in preparation of the sample are set forth below.

C-1

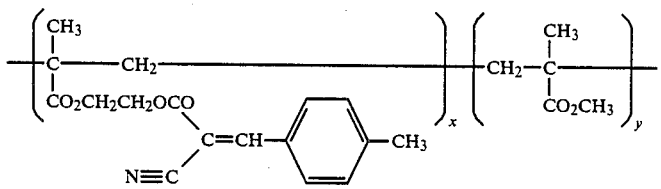

x:y = 7:3 (weight ratio)

C-2

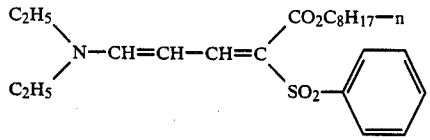

C-3

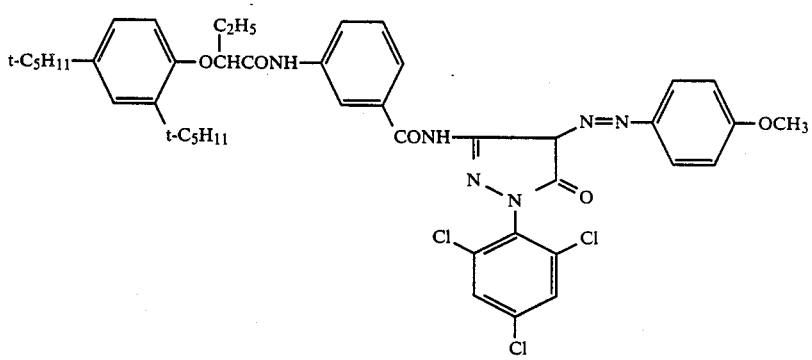

C-4

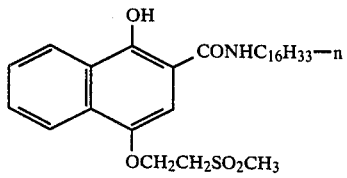

-continued
C-5
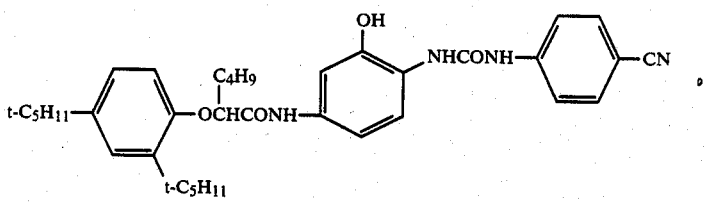
C-6
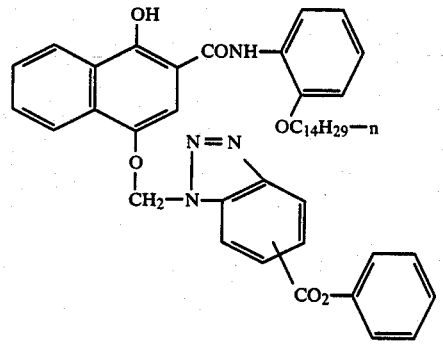
C-7
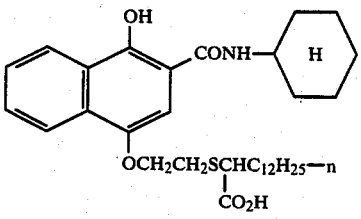
C-8
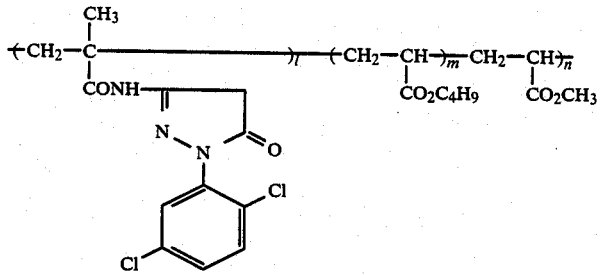
l:m:n = 2:1:1 (weight ratio)
C-10
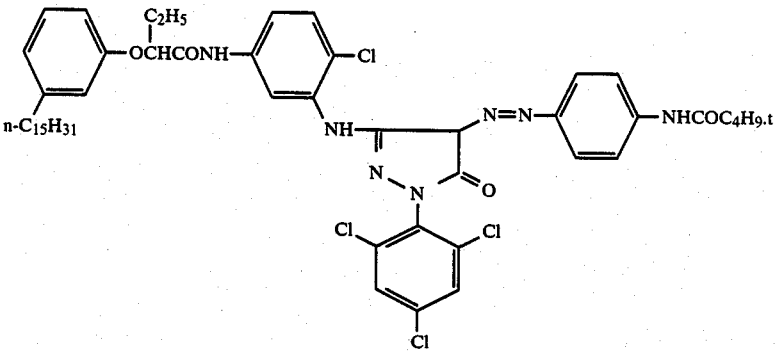

-continued
C-11
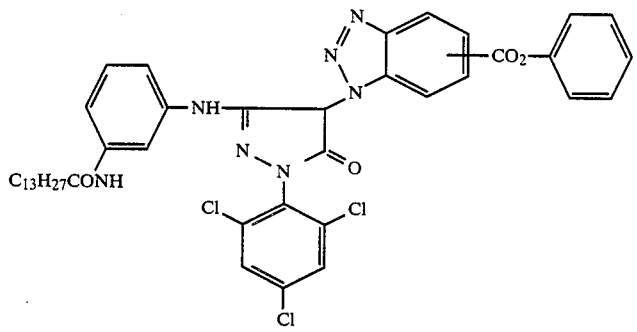
C-12
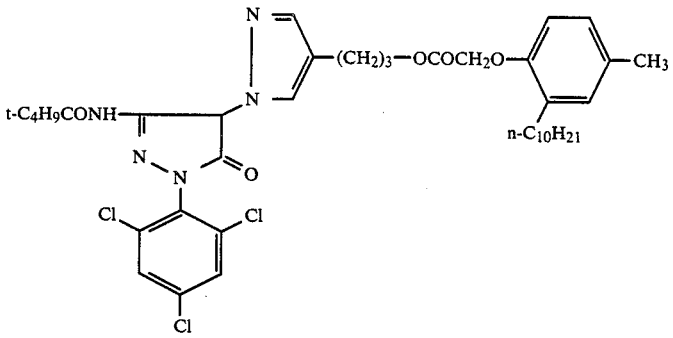
C-13
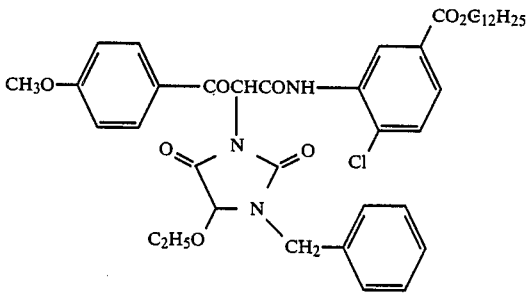
C-14
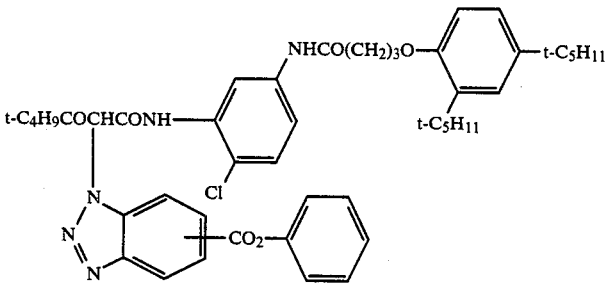
C-15
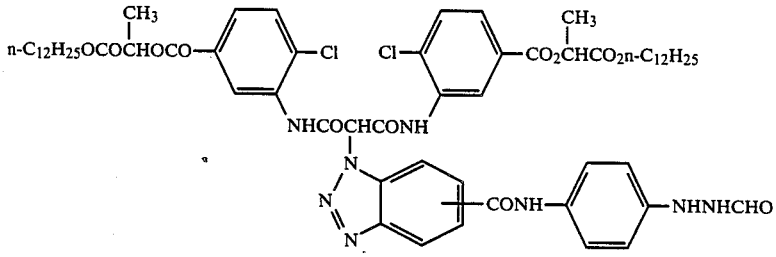
$(CH_2{=}CHSO_2CH_2CONHCH_2)_2$
C-16

-continued
C-17
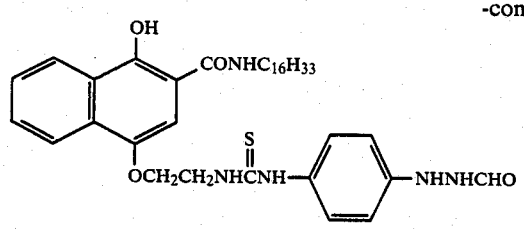
C-18
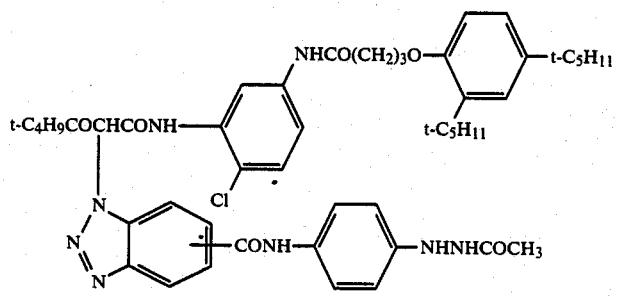
C-19
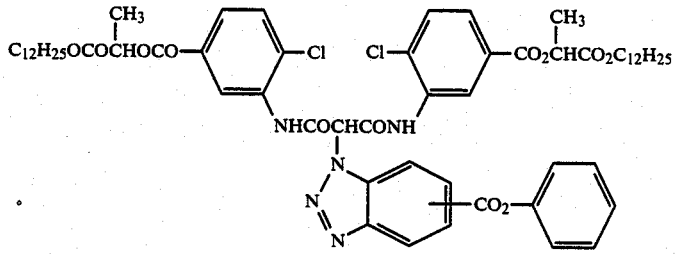
Sensitizing Dye A
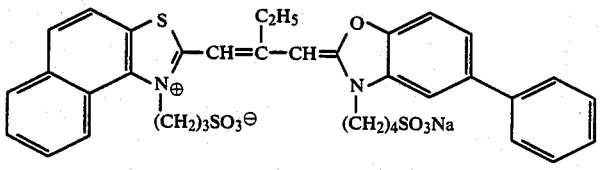
Sensitizing Dye B
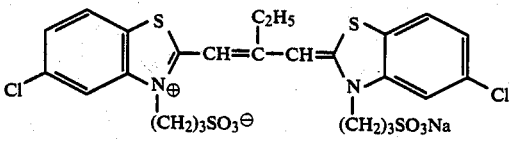
Sensitizing Dye C
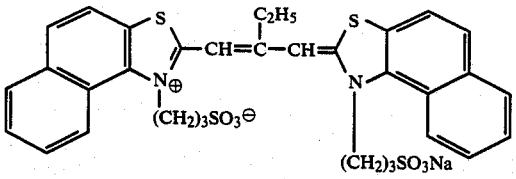
Sensitizing Dye D
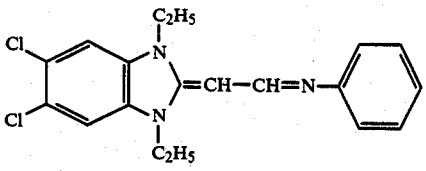
Sensitizing Dye E
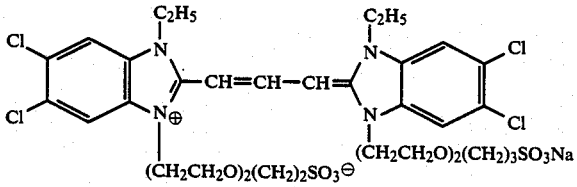

-continued

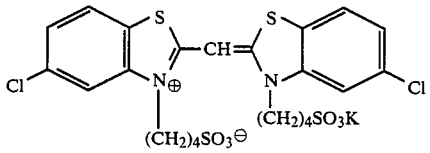

Sensitizing Dye F

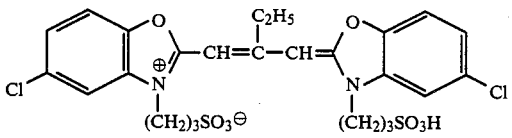

Sensitizing Dye G

Preparation of Sample 101

Sample 101 was prepared in the same manner as Sample 119 except that Compound (I-1) was added to the fourth layer and the fifth layer of Sample 119 in the amount shown in Table 1 below, respectively.

Preparation of Samples 102 to 115 and 120 to 124

Samples 102 to 115 and 120 to 124 were prepared in the same manner as Sample 101 except that the compounds shown in Table 1 below were added in the amounts shown in Table 1 below in place of Compound (I-1) used in Sample 101, respectively.

Preparation of Sample 116

Sample 116 was prepared in the same manner as Sample 119 except that Compound (I-1) was added to the second layer of Sample 119 in the amount shown in Table 1 below.

Preparation of Samples 117, 118, 125 to 127

Samples 117, 118, 125 to 127 were prepared in the same manner as Sample 116 except that the compounds shown in Table 1 below were added in the amounts shown in Table 1 below in place of Compound (I-1) used in Sample 116.

Samples 101 to 127 thus prepared were divided into two parts, and one part was subjected to red wedge exposure and the other part was subjected to white (red light+green light+blue light) wedge exposure. The amount of red exposure in the white wedge exposure was the same as the amount of red wedge exposure.

The exposed samples were then subjected to color development processing.

The color development processing was carried out according to the following steps, at 38° C.

| Processing Stage | Time |
|---|---|
| Color Development | 3 min 15 sec |
| Bleaching | 6 min 30 sec |
| Washing with Water | 2 min 10 sec |
| Fixing | 4 min 20 sec |
| Washing with Water | 3 min 15 sec |
| Stabilizing | 1 min 05 sec |

The compositions of the processing solutions used for the above-described steps were as follows.

| | |
|---|---|
| Color Developing Solution: | |
| Diethylenetriaminepentaacetic Acid | 1.0 g |
| 1-Hydroxyethylidene-1,1-diphosphonic Acid | 2.0 g |
| Sodium Sulfite | 4.0 g |
| Potassium Carbonate | 30.0 g |
| Potassium Bromide | 1.4 g |
| Potassium Iodide | 1.3 mg |
| Hydroxylamine Sulfate | 2.4 g |
| 4-(N—Ethyl-N—β-hydroxyethylamino)-2-methylaniline Sulfate | 4.5 g |
| Water to make | 1.0 liter |
| | pH: 10.0 |
| Bleaching Solution: | |
| Ammonium Ethylenediaminetetraacetate Iron (III) | 100.0 g |
| Disodium Ethylenediaminetetraacetate | 10.0 g |
| Ammonium Bromide | 150.0 g |
| Ammonium Nitrate | 10.0 g |
| Water to make | 1.0 liter |
| | pH: 6.0 |
| Fixing Solution: | |
| Disodium Ethylenediaminetetraacetate | 1.0 g |
| Sodium Sulfite | 4.0 g |
| Ammonium Thiosulfate (70% aq. soln.) | 175.0 ml |
| Sodium Hydrogensulfite | 4.6 g |
| Water to make | 1.0 liter |
| | pH: 6.6 |
| Stabilizing Solution: | |
| Formalin (40%) | 2.0 ml |
| Polyoxyethylene p-Monononylphenyl Ether (average polymerization degree: 10) | 0.3 g |
| Water to make | 1.0 liter |

With these samples thus processed, the interimage effect and sharpness were evaluated. The interimage effect was determined by the difference in exposure amount (Δ log E) at a density of 0.6 between a cyan image obtained by the red exposure and a cyan image obtained by the white exposure. The larger the value of Δ log E, the greater the interimage effect is. Further, the sharpness was determined using an MTF value. The results thus obtained are shown in Table 1 below.

TABLE 1

| Sample No. | Compound | Amount Added per Layer (mol/m²) | Layer Added | Interimage Effect Δlog E at Cyan Density (D) of 0.6 | Sharpness MTF Value of Cyan Image (10 c/mm) |
|---|---|---|---|---|---|
| 101 (Invention) | (I-1) | $1.0 \times 10^{-5}$ | 4th layer + 5th layer | 0.49 | 0.63 |
| 102 (Invention) | (I-3) | " | " | 0.50 | 0.64 |

TABLE 1-continued

| Sample No. | Compound | Amount Added per Layer (mol/m²) | Layer Added | Interimage Effect Δlog E at Cyan Density (D) of 0.6 | Sharpness MTF Value of Cyan Image (10 c/mm) |
|---|---|---|---|---|---|
| 103 (Invention) | (I-4) | " | " | 0.48 | 0.63 |
| 104 (Invention) | (I-5) | " | " | 0.49 | 0.64 |
| 105 (Invention) | (I-8) | " | " | 0.44 | 0.58 |
| 106 (Invention) | (I-9) | " | " | 0.47 | 0.61 |
| 107 (Invention) | (I-11) | " | " | 0.48 | 0.61 |
| 108 (Invention) | (I-13) | " | " | 0.49 | 0.62 |
| 109 (Invention) | (I-14) | " | " | 0.45 | 0.59 |
| 110 (Invention) | (I-16) | " | " | 0.44 | 0.57 |
| 111 (Invention) | (I-22) | " | " | 0.43 | 0.58 |
| 112 (Invention) | (I-24) | " | " | 0.42 | 0.55 |
| 113 (Invention) | (I-28) | " | " | 0.47 | 0.60 |
| 114 (Invention) | (I-38) | " | " | 0.50 | 0.63 |
| 115 (Invention) | (I-40) | " | " | 0.50 | 0.64 |
| 116 (Invention) | (I-1) | $3.0 \times 10^{-5}$ | 2nd layer | 0.48 | 0.62 |
| 117 (Invention) | (I-3) | " | " | 0.50 | 0.63 |
| 118 (Invention) | (I-28) | " | " | 0.47 | 0.61 |
| 119 (Comparison) | — | — | — | 0.22 | 0.43 |
| 120 (Comparison) | Comparative Compound A | $0.5 \times 10^{-5}$ | 4th layer + 5th layer | 0.26 | 0.45 |
| 121 (Comparison) | Comparative Compound B | " | " | 0.30 | 0.46 |
| 122 (Comparison) | Comparative Compound C | $1.0 \times 10^{-5}$ | " | 0.22 | 0.44 |
| 123 (Comparison) | Comparative Compound D | " | " | 0.29 | 0.45 |
| 124 (Comparison) | Comparative Compound E | " | " | 0.34 | 0.48 |
| 125 (Comparison) | Comparative Compound C | $3.0 \times 10^{-5}$ | 2nd layer | 0.22 | 0.43 |
| 126 (Comparison) | Comparative Compound D | " | " | 0.28 | 0.45 |
| 127 (Comparison) | Comparative Compound E | " | " | 0.33 | 0.48 |

Comparative Compound A:

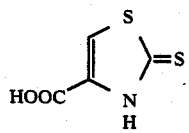

(Compound as described in U.S. Pat. No. 3,536,486)

Comparative Compound B:

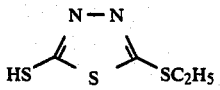

Comparative Compound C:

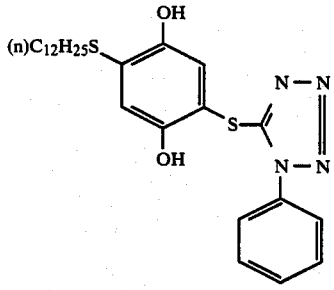

(Compound as described in Japanese Patent Application (OPI) No. 129536/74)

Comparative Compound D:

-continued

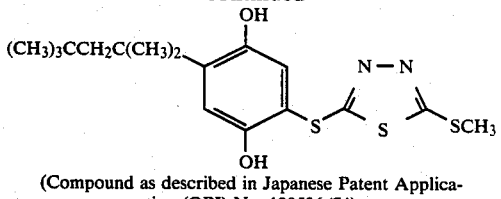

(Compound as described in Japanese Patent Application (OPI) No. 129536/74)

Comparative Compound E:

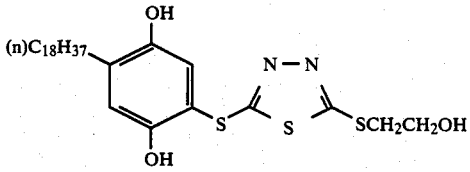

(Compound as described in Japanese Patent Publication No. 24462/85)

From the results shown in Table 1 above, it is apparent that the samples according to the present invention exhibit a remarkably large interimage effect and excellent sharpness in comparison with the comparative samples.

EXAMPLE 2

Onto a triacetate film support were coated the following first to twelfth layers in the order shown below to prepare a color photograph light-sensitive material, which was designated Sample 213.

First Layer: Antihalation Layer

A gelatin layer containing black colloidal silver.

Second Layer: Gelatin Intermediate Layer 200 g of 2,5-di-tert-octylhydroquinone was dissolved in 100 cc of dibutyl phthalate and 100 cc of ethyl acetate, and the solution was stirred with 1 kg of a 10% aqueous solution of gelatin at a high speed. 2 kg of the resulting emulsion was mixed with 1.5 kg of a 10% aqueous solution of gelatin together with 1 kg of a fine grain emulsion (particle size: 0.06 μm, content of silver iodide in silver iodobromide: 1 mol%) which was not chemically sensitized. The resulting mixture was applied so as to result in a dry layer thickness of 2 μm (silver amount: 0.4 g/m$^2$).

Third Layer: Low Speed Red-Sensitive Emulsion Layer 100 g of a cyan coupler, i.e., 2-(heptafluorobutyramido)-5-[2'-(2",4"-di-tert-aminophenoxy)-butyramido]phenol was dissolved in 100 cc of tricresyl phosphate and 100 cc of ethyl acetate, and the solution was stirred with 1 kg of a 10% aqueous solution of gelatin at a high speed. 500 g of the resulting emulsion was mixed with 1 kg of a red-sensitive silver iodobromide emulsion (which contained 70 g of silver and 60 g of gelatin and had an iodide content of 4 mol%). The resulting mixture was applied so as to result in a dry layer thickness of 1 μm (silver amount: 0.5 g/m$^2$).

Fourth Layer: High Speed Red-Sensitive Emulsion Layer 100 g of a cyan coupler, i.e., 2-(heptafluorobutyramido)-5-[2'-(2",4"-di-tert-aminophenoxy)-butyramido]phenol was dissolved in 100 cc of tricresyl phosphate and 100 cc of ethyl acetate, and the solution was stirred with 1 kg of a 10% aqueous solution of gelatin at a high speed. 1,000 g of the resulting emulsion was mixed with 1 kg of a red-sensitive silver iodobromide emulsion (which contained 70 g of silver and 60 g of gelatin and had an iodide content of 2.5 mol%). The resulting mixture was applied so as to result in a dry layer thickness of 2.5 μm (silver amount: 0.7 g/m$^2$).

Fifth Layer: Intermediate Layer 200 g of 2,5-di-tert-octylhydroquinone was dissolved in 100 cc of dibutyl phthalate and 100 cc of ethyl acetate, and the solution was stirred with 1 kg of a 10% aqueous solution of gelatin at a high speed. 1 kg of the resulting emulsion was mixed with 1 kg of a 10% aqueous solution of gelatin, and the mixture was applied so as to result in a dry layer thickness of 1 μm.

Sixth Layer: Low Speed Green-Sensitive Emulsion Layer 300 g of an emulsion which was prepared in the same manner as the emulsion of the third layer except for using a magenta coupler, i.e., 1-(2,4,6-trichlorophenyl)-3-[3-(2,4-di-tert-amylphenoxyacetamido)benzamido]-5-pyrazolone, instead of the cyan coupler was mixed with 1 kg of a green-sensitive silver iodobromide emulsion (which contained 70 g of silver and 60 g of gelatin and had an iodide content of 3 mol%), and the mixture was applied so as to result in a dry layer thickness of 1.3 μm (silver amount: 0.7 g/m$^2$).

Seventh Layer: High Speed Green-Sensitive Emulsion Layer 1,000 g of an emulsion which was prepared in the same manner as the emulsion of the third layer except for using a magenta coupler, i.e., 1-(2,4,6-trichlorophenyl)-3-[3-(2,4-di-tert-amylphenoxyacetamido)benzamido]-5-pyrazolone, instead of the cyan coupler was mixed with 1 kg of a green-sensitive silver iodobromide emulsion (which contained 70 g of silver and 60 g of gelatin and had an iodide content of 2.5 mol%), and the resulting mixture was applied so as to result in a dry layer thickness of 3.5 μm (silver amount: 0.8 g/m$^2$).

Eighth Layer: Yellow Filter Layer

An emulsion containing yellow colloidal silver was applied so as to result in a dry layer thickness of 1 μm.

Ninth Layer: Low Speed Blue-Sensitive Emulsion Layer 1,000 g of an emulsion which was prepared in the same manner as the emulsion used in the third layer except for using a yellow coupler, i.e., α-pivaloyl-α-(1-benzyl-5-ethoxy-3-hydantoinyl)-2-chloro-5-dodecyloxycarbonylacetanilide, instead of the cyan coupler was mixed with 1 kg of a blue-sensitive silver iodobromide emulsion (which contained 70 g of silver and 60 g of gelatin and had an iodide content of 2.5 mol%), and the resulting mixture was applied so as to result in a dry layer thickness of 1.5 μm (silver amount: 0.6 g/m$^2$).

Tenth Layer: High Speed Blue-Sensitive Emulsion Layer 1,000 g of an emulsion which was prepared in the same manner as the emulsion of the third layer except for using a yellow coupler, i.e., α-pivaloyl-α-(1-benzyl-5-ethoxy-3-hydantoinyl)-2-chloro-5-dodecyloxycarbonylacetanilide, instead of the cyan coupler was mixed with 1 kg of the above-described blue-sensitive silver iodobromide emulsion (which contained 70 g of silver and 60 g of gelatin and had an iodide content of 2.5 mol%), and the resulting mixture was applied so as to result in a dry layer thickness of 3 μm (silver amount: 1.1 g/m$^2$).

Eleventh Layer: Second Protective Layer 1,000 g of an emulsion of Ultraviolet Ray Absorbing Agent C-1 used in Example 1 was mixed with 1 kg of a 10% aqueous solution of gelatin, and the mixture was applied so as to result in a dry layer thickness of 2 μm.

Twelfth Layer: First Protective Layer

A 10% aqueous solution of gelatin containing an emulsion of fine silver halide grains having the surfaces thereof fogged (particle size: 0.06 μm, content of silver iodide in silver iodobromide: 1 mol%) was applied so as to result in a coated silver amount of 0.1 g/m$^2$ and a dry layer thickness of 0.8 μm.

In each of the above layers, Gelatin Hardener C-16 and a surface active agent were further incorporated in addition to the above-described components.

Preparation of Sample 201

Sample 201 was prepared in the same manner as Sample 213 except that Compound (I-1) was added to the coating solutions for the third layer, the sixth layer, the seventh layer and the ninth layer of Sample 213 in the amount shown in Table 2 below, respectively.

Preparation of Samples 202 to 212 and 214 to 216

Samples 202 to 212 and 214 to 216 were prepared in the same manner as Sample 201 except that the compounds shown in Table 2 below are added in the TABLE 2-continued

| Sample No. | Compound | Amount Added per Layer (mol/m²) | Δlog E at Cyan Density (D) of 1.0 | Δlog E at Magenta Density (D) of 1.0 | Δlog E at Yellow Density (D) of 1.0 |
|---|---|---|---|---|---|
| 216 (Comparison) | Compound B Comparative Compound C | " | 0.30 | 0.24 | 0.23 |

Comparative Compound A:

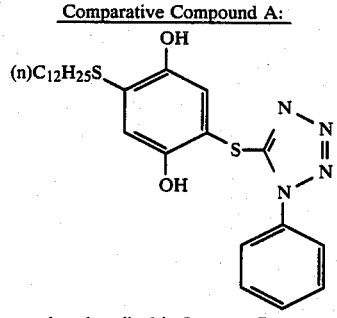

(Compound as described in Japanese Patent Application (OPI) No. 129536/74)

Comparative Compound B:

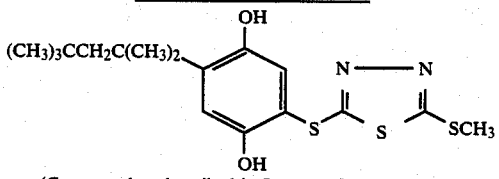

(Compound as described in Japanese Patent Application (OPI) No. 129536/74)

Comparative Compound C:

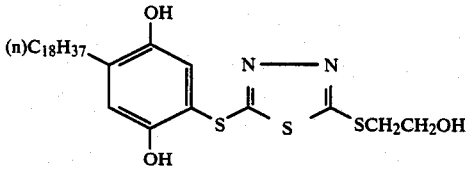

(Compound as described in Japanese Patent Publication No. 24462/85)

From the results shown in Table 2 above, it is apparent that the samples according to the present invention exhibit an extremely large interimage effect in comparison with the comparative samples.

EXAMPLE 3

Preparation of Emulsion A

Potassium bromide, potassium iodide and silver nitrate were added to an aqueous solution of gelatin with vigorous stirring to prepare a silver iodobromide emulsion having an iodide content of 3 mol% and an average particle size of 0.6 μm. After desalting, the emulsion was subjected to optimum gold and sulfur sensitization with chloroauric acid and sodium thiosulfate to prepare a silver iodobromide emulsion which was designated Emulsion A.

Preparation of Emulsion B

In a manner similar to the preparation of Emulsion A, a silver iodobromide emulsion having an iodide content of 3 mol% and an average particle size of 1.2 μm was prepared. The resulting silver iodobromide emulsion was designated Emulsion B.

On a cellulose triacetate film support were coated the layers having the compositions described below in this order to prepare a black-and-white photographic light-sensitive material.

First Layer: Low Speed Silver Halide Emulsion Layer

Emulsion A (coated silver amount: 1 g/m²)

Second Layer: High Speed Silver Halide Emulsion Layer

Emulsion B (coated silver amount: 2.5 g/m²)

Third Layer: Protective Layer

Gelatin (1.3 g/m²)

Polymethyl methacrylate particles (0.05 g/m²) (diameter: 1.5 μm)

In each of the above layers, Gelatin Hardener C-16, a surface active agent and a viscosity imparting agent, i.e., sodium polystyrenesulfonate, were further incorporated in addition to the above-described components. The black-and-white photographic light-sensitive material thus prepared was designated Sample 312.

Preparation of Sample 301

Sample 301 was prepared in the same manner as Sample 312 except that Compound (I-3) was added to Emulsion A used in the first layer and Emulsion B used in the second layer in the amount shown in Table 3 below at the step of the formation of silver halide particles of the emulsions respectively.

Preparation of Samples 302 to 311 and 313 and 315

Samples 302 to 311 and 313 to 315 were prepared in the same manner as Sample 301 except that the compounds shown in Table 3 below were added in the amounts shown in Table 3 below in place of Compound (I-3) used in Sample 301, respectively.

These samples were exposed through a pattern for measuring graininess or a pattern for measuring sharpness and then subjected to development processing in the following manner.

| | |
|---|---|
| Developing Solution: | |
| Metol | 2 g |
| Sodium Sulfite | 100 g |
| Hydroquinone | 5 g |
| Borax (5 hydrate) | 1.53 g |
| Water to make | 1 liter |
| Fixing Solution: | |
| Ammonium Thiosulfate | 200.0 g |
| Sodium Sulfite (anhydrous) | 20.0 g |
| Boric Acid | 8.0 g |
| Disodium Ethylenediaminetetraacetate | 0.1 g |
| Aluminum Sulfate | 15.0 g |
| Sulfuric Acid | 2.0 g |
| Glacial Acetic Acid | 22.0 g |
| Water to make | 1.0 liter |
| Adjusted pH to | 4.2 |

amounts shown in Table 2 below in place of Compound (I-1) used in Sample 201, respectively.

Samples 201 to 216 thus prepared were divided into two parts, and one part was subjected to red wedge exposure, green wedge exposure and blue wedge exposure in different areas thereof respectively and the other part was subjected to white (red light+green light+blue light) wedge exposure. The amounts of red exposure, green exposure and blue exposure in the white wedge exposure were the same as the amounts of red wedge exposure, green wedge exposure and blue wedge exposure, respectively.

These exposed samples were then subjected to color development processing in the following manner.

| Processing Steps | Time (min) | Temperature (°C.) |
|---|---|---|
| First Development | 6 | 38 |
| Washing with Water | 2 | " |
| Reversal | 2 | " |
| Color Development | 6 | " |
| Controlling | 2 | " |
| Bleaching | 6 | " |
| Fixing | 4 | " |
| Washing with Water | 4 | " |
| Stabilizing | 1 | Room temperature |
| Drying | | |

The compositions of the processing solutions used for the above-described steps were as follows.

| | |
|---|---|
| First Developing Solution: | |
| Water | 700 ml |
| Pentasodium Nitrilo-N,N,N—trimethylene-phosphonate | 3 g |
| Sodium Sulfite | 20 g |
| Hydroquinone Monosulfonate | 30 g |
| Sodium Carbonate (monohydrate) | 30 g |
| 1-Phenyl-4-methyl-4-hydroxymethyl-3-pyrazolidone | 2 g |
| Potassium Bromide | 2.5 g |
| Potassium Thiocyanate | 1.2 g |
| Potassium Iodide (0.1% solution) | 2 ml |
| Water to make | 1,000 ml |
| | pH: 10.1 |
| Reversal Solution: | |
| Water | 700 ml |
| Pentasodium Nitrilo-N,N,N—trimethylene-phosphonate | 3 g |
| Stannous Chloride (dihydrate) | 1 g |
| p-Aminophenol | 0.1 g |
| Sodium Hydroxide | 8 g |
| Glacial Acetic Acid | 15 ml |
| Water to make | 1,000 ml |
| Color Developing Solution: | |
| Water | 700 ml |
| Pentasodium Nitrilo-N,N,N—trimethylene-phosphonate | 3 g |
| Sodium Sulfite | 7 g |
| Sodium Tertiary Phosphate (12 hydrate) | 36 g |
| Potassium Bromide | 1 g |
| Potassium Iodide (0.1% solution) | 90 ml |
| Sodium Hydroxide | 3 g |
| Citrazinic Acid | 1.5 g |
| N—Ethyl-N—(β-methanesulfonamidoethyl)-3-methyl-4-aminoaniline Sulfate | 11 g |
| Ethylenediamine | 3 g |
| Water to make | 1,000 ml |
| Controlling Solution: | |
| Water | 700 ml |
| Sodium Sulfite | 12 g |
| Sodium Ethylenediaminetetraacetate (dihydrate) | 8 g |
| Thioglycerol | 0.4 ml |
| Glacial Acetic Acid | 3 ml |
| Water to make | 1,000 ml |
| Bleaching Solution: | |
| Water | 800 ml |
| Sodium Ethylenediaminetetraacetate (dihydrate) | 2 g |
| Ammonium Ethylenediaminetetraacetate Iron (III) (dihydrate) | 120 g |
| Potassium Bromide | 100 g |
| Water to make | 1,000 ml |
| Fixing Solution: | |
| Water | 800 ml |
| Sodium Thiosulfate | 80.0 g |
| Sodium Sulfite | 5.0 g |
| Sodium Bisulfite | 5.0 g |
| Water to make | 1,000 ml |
| Stabilizing Solution: | |
| Water | 800 ml |
| Formaldehyde (37 wt %) | 5.0 ml |
| Fuji Driwel (surface active agent, manufactured by Fuji Photo Film Co., Ltd.) | 5.0 ml |
| Water to make | 1,000 ml |

With these samples thus processed, the interimage effect was evaluated by measuring the difference in exposure amount (Δlog E) at a density of 1.0 between a cyan image obtained by the red exposure and a cyan image obtained by the white exposure. In the same manner, the values of Δlog E were measured with respect to the green exposure and the blue exposure, respectively. The results thus obtained are shown in Table 2 below.

TABLE 2

| Sample No. | Compound | Amount Added per Layer (mol/m²) | Δlog E at Cyan Density (D) of 1.0 | Δlog E at Magenta Density (D) of 1.0 | Δlog E at Yellow Density (D) of 1.0 |
|---|---|---|---|---|---|
| 201 (Invention) | (I-1) | $1.0 \times 10^{-5}$ | 0.52 | 0.42 | 0.36 |
| 202 (Invention) | (I-3) | " | 0.53 | 0.44 | 0.37 |
| 203 (Invention) | (I-5) | " | 0.53 | 0.43 | 0.37 |
| 204 (Invention) | (I-12) | " | 0.51 | 0.42 | 0.34 |
| 205 (Invention) | (I-15) | " | 0.50 | 0.41 | 0.34 |
| 206 (Invention) | (I-17) | " | 0.46 | 0.36 | 0.31 |
| 207 (Invention) | (I-27) | " | 0.52 | 0.44 | 0.37 |
| 208 (Invention) | (I-34) | " | 0.47 | 0.38 | 0.33 |
| 209 (Invention) | (I-36) | " | 0.46 | 0.37 | 0.33 |
| 210 (Invention) | (I-39) | " | 0.47 | 0.40 | 0.33 |
| 211 (Invention) | (I-54) | " | 0.52 | 0.44 | 0.36 |
| 212 (Invention) | (I-57) | " | 0.52 | 0.42 | 0.36 |
| 213 (Comparison) | — | — | 0.25 | 0.15 | 0.10 |
| 214 (Comparison) | Comparative Compound A | $1.0 \times 10^{-5}$ | 0.26 | 0.17 | 0.13 |
| 215 (Comparison) | Comparative | " | 0.26 | 0.18 | 0.15 |

Black-and-white development was carried out at 20° C. for 7 minutes using the developing solution described above.

With these samples, graininess and sharpness were evaluated. The graininess (RMS granularity) was indicated using a value which was 1,000 times the standard deviation of changes in density formed in the case of scanning by a microdensitometer. Further, the sharpness was determined using an MTF value. The results thus obtained are shown in Table 3 below.

TABLE 3

| Sample No. | Compound | Amount Added per Layer (mol/m$^2$) | Graininess at Density (D) of 1.5 | Sharpness at 10 c/mm |
|---|---|---|---|---|
| 301 (Invention) | (I-3) | $1.0 \times 10^{-5}$ | 21 | 0.99 |
| 302 (Invention) | (I-5) | " | 31 | 0.98 |
| 303 (Invention) | (I-7) | " | 22 | 0.97 |
| 304 (Invention) | (I-10) | " | 23 | 0.97 |
| 305 (Invention) | (I-18) | " | 23 | 0.96 |
| 306 (Invention) | (I-23) | " | 24 | 0.95 |
| 307 (Invention) | (I-25) | " | 23 | 0.97 |
| 308 (Invention) | (I-29) | " | 24 | 0.95 |
| 309 (Invention) | (I-30) | " | 23 | 0.96 |
| 310 (Invention) | (I-38) | " | 21 | 0.98 |
| 311 (Invention) | (I-49) | " | 23 | 0.97 |
| 312 (Comparison) | — | — | 28 | 0.87 |
| 313 (Comparison) | Comparative Compound A | $1.0 \times 10^{-5}$ | 28 | 0.88 |
| 314 (Comparison) | Comparative Compound B | " | 27 | 0.88 |
| 315 (Comparison) | Comparative Compound C | " | 26 | 0.89 |

Comparative Compound A:

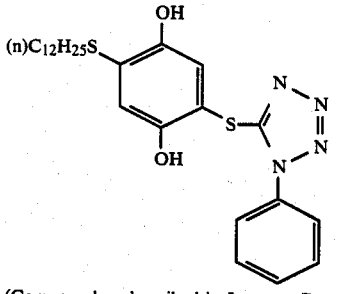

(Compound as described in Japanese Patent Application (OPI) No. 129536/74)

Comparative Compound B:

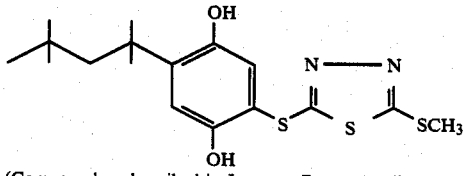

(Compound as described in Japanese Patent Application (OPI) No. 129536/74)

Comparative Compound C:

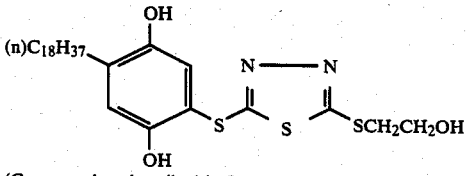

(Compound as described in Japanese Patent Publication No. 24462/85)

From the results shown in Table 3 above, it can be seen that the samples according to the present invention exhibit improved graininess and sharpness in comparison with the comparative samples.

EXAMPLE 4

Preparation of Light-Sensitive Silver Halide Emulsion

A silver iodobromide emulsion (iodide content: 2 mol%) having an average particle size of 1.3 μm was prepared from silver nitrate, potassium bromide and potassium iodide by a conventional ammonia method. The emulsion was subjected to chemical sensitization by the gold and sulfur sensitization method using chloroauric acid and sodium thiosulfate, washed by a conventional precipitation method, and 4-hydroxy-6-methyl-1,3,3a,7-tetraazaindene was added as a stabilizer to the emulsion to obtain a light-sensitive silver iodobromide emulsion.

Preparation of Samples 401 to 429

Samples 401 to 429 were prepared in which an emulsion layer consisting of the light-sensitive silver halide emulsion prepared in accordance with the above method and the compounds represented by the general formula (I) of the present invention or Comparative Compounds A, B and C, and a protective layer of an aqueous gelatin solution were each uniformly and successively coated on both sides of a subbed polyester film base.

In this case, the coated amount was the same at both sides, the total amount of the coated silver on both sides being 8.0 g/m$^2$, the amount of the coated gelatin of the protective layer being 2.6 g/m$^2$ and that of the coated gelatin of the emulsion layer being 5.2 g/m$^2$.

These samples thus prepared were held between two sheets of fluorescence sensitizing paper containing caldium tungstate, a square wave chart made of aluminum was closely contacted as an object with the sheets, and they were exposed to X-rays such that a density of 1.0 was obtained. Thereafter, they were developed with the following developing solution at 35° C. for 25 seconds, followed by fixing, washing with water and drying.

| Developing Solution: | |
|---|---|
| Potassium Hydroxide | 29.14 g |
| Glacial Acetic Acid | 10.96 g |
| Potassium Sulfite | 44.20 g |
| Sodium Bicarbonate | 7.50 g |
| Boric Acid | 1.00 g |
| Diethylene Glycol | 28.96 g |
| Ethylenediaminetetraacetic Acid | 1.67 g |
| 5-Methylbenzotriazole | 0.06 g |
| 5-Nitroindazole | 0.25 g |
| Hydroquinone | 30.00 g |
| 1-Phenyl-3-pyrazolidone- | 1.50 g |
| Glutaraldehyde | 4.93 g |
| Sodium Metabisulfite | 12.60 g |
| Water to make | 1 liter |

The samples thus processed were measured for MTF with a microphotometer. The results obtained are shown in Table 4 below.

TABLE 4

| Sample No. | Compound | Amount Added (mol/mol Ag) | MTF 0.5 line/mm | MTF 1 line/mm |
|---|---|---|---|---|
| 401 (Control) | — | — | 0.81 | 0.62 |

TABLE 4-continued

| Sample No. | Compound | Amount Added (mol/mol Ag) | MTF 0.5 line/mm | MTF 1 line/mm |
|---|---|---|---|---|
| 402 (Invention) | (I-1) | $5 \times 10^{-3}$ | 0.90 | 0.72 |
| 403 (Invention) | " | $10 \times 10^{-3}$ | 0.91 | 0.75 |
| 404 (Invention) | (I-2) | $5 \times 10^{-3}$ | 0.88 | 0.70 |
| 405 (Invention) | " | $10 \times 10^{-3}$ | 0.89 | 0.72 |
| 406 (Invention) | (I-3) | $5 \times 10^{-3}$ | 0.91 | 0.74 |
| 407 (Invention) | " | $10 \times 10^{-3}$ | 0.92 | 0.79 |
| 408 (Invention) | (I-5) | $5 \times 10^{-3}$ | 0.90 | 0.73 |
| 409 (Invention) | " | $10 \times 10^{-3}$ | 0.92 | 0.75 |
| 410 (Invention) | (I-7) | $5 \times 10^{-3}$ | 0.91 | 0.72 |
| 411 (Invention) | " | $10 \times 10^{-3}$ | 0.92 | 0.74 |
| 412 (Invention) | (I-13) | $5 \times 10^{-3}$ | 0.91 | 0.73 |
| 413 (Invention) | " | $10 \times 10^{-3}$ | 0.92 | 0.78 |
| 414 (Invention) | (I-41) | $5 \times 10^{-3}$ | 0.92 | 0.75 |
| 415 (Invention) | " | $10 \times 10^{-3}$ | 0.94 | 0.79 |
| 416 (Invention) | (I-43) | $5 \times 10^{-3}$ | 0.88 | 0.70 |
| 417 (Invention) | " | $10 \times 10^{-3}$ | 0.91 | 0.71 |
| 418 (Invention) | (I-45) | $5 \times 10^{-3}$ | 0.91 | 0.74 |
| 419 (Invention) | " | $10 \times 10^{-3}$ | 0.93 | 0.78 |
| 420 (Invention) | (I-47) | $5 \times 10^{-3}$ | 0.89 | 0.70 |
| 421 (Invention) | " | $10 \times 10^{-3}$ | 0.90 | 0.72 |
| 422 (Invention) | (I-49) | $5 \times 10^{-3}$ | 0.92 | 0.74 |
| 423 (Invention) | " | $10 \times 10^{-3}$ | 0.94 | 0.76 |
| 424 (Comparison) | Comparative Compound A | $5 \times 10^{-3}$ | 0.82 | 0.63 |
| 425 (Comparison) | Comparative Compound A | $10 \times 10^{-3}$ | 0.83 | 0.64 |
| 426 (Comparison) | Comparative Compound B | $5 \times 10^{-3}$ | 0.84 | 0.67 |
| 427 (Comparison) | Comparative Compound B | $10 \times 10^{-3}$ | 0.86 | 0.68 |
| 428 (Comparison) | Comparative Compound C | $5 \times 10^{-3}$ | 0.85 | 0.67 |
| 429 (Comparison) | Comparative Compound C | $10 \times 10^{-3}$ | 0.86 | 0.68 |

Comparative Compound A:

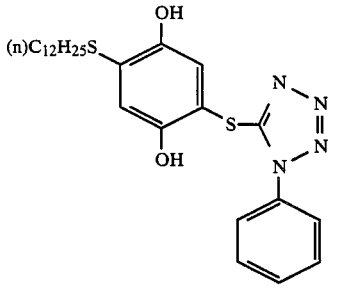

(Compound as described in Japanese Patent Application (OPI) No. 129536/74)

Comparative Compound B:

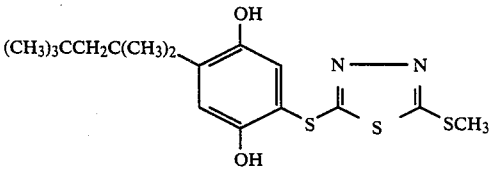

(Compound as described in Japanese Patent Application (OPI) No. 129536/74)

Comparative Compound C:

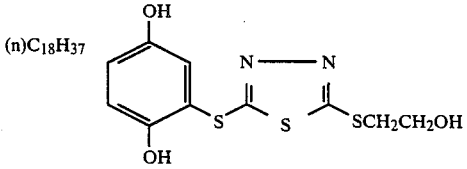

(Compound as described in Japanese Patent Publica-

-continued tion No. 24462/85)

From the results shown in Table 4 above, it is apparent that the MTF values of the photographic light-sensitive materials to which the compounds according to the present invention are added are larger and the sharpness is better than the MTF values and sharpness of the comparative samples having no compounds according to the present invention. The effect of the compounds according to the present invention is larger than that of Comparative Compounds A, B and C, which makes clear the usefulness of the compounds according to the present invention.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide emulsion layer, wherein the silver halide photographic material contains at least one compound represented by the following general formula (I):

$$A\text{-}(Time)_t\text{-}X \qquad (I)$$

wherein A represents an oxidation reduction moiety comprising an atomic group which does not enable $\text{-}(Time)_t\text{-}X$ to be released until the oxidation reduction moiety is oxidized during photographic development processing; Time represents a timing group which is connected to A through a sulfur atom, a nitrogen atom or an oxygen atom; t represents an integer of 0 or 1; and X represents a group represented by the following general formula (II):

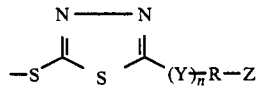

(II)

wherein R represents a straight chain or branched chain alkylene group, a straight chain or branched chain alkenylene group, a straight chain or branched chain aralkylene group or an arylene group; Z represents a polar substituent; Y represents

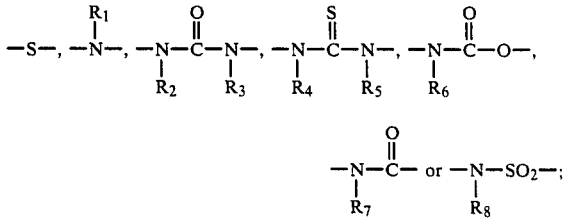

$R_1$, $R_2$, $R_3$, $R_4$, $R_5$, $R_6$, $R_7$ and $R_8$ each represents a hydrogen atom, a substituted or unsubstituted alkyl group, a substituted or unsubstituted aryl group, a substituted or unsubstituted alkenyl group or a substituted or unsubstituted aralkyl group; and n represents an integer of 0 or 1.

2. A silver halide photographic material as claimed in claim 1, wherein the oxidation reduction moiety represented by A is a hydroquinone, a catechol, a p-aminophenol, an o-aminophenol, a 1,2-naphthalenediol, a 1,4-naphthalenediol, a 1,6-naphthalenediol, a 1,2-aminonaphthol, a 1,4-aminonaphthol or a 1,6-aminonaphthol.

3. A silver halide photographic material as claimed in claim 2, wherein an amino group included in the moiety is substituted with a sulfonyl group having from 1 to 25 carbon atoms or an acyl group having from 1 to 25 carbon atoms.

4. A silver halide photographic material as claimed in claim 2, wherein the moiety has one or more substituents having up to 25 carbon atoms selected from the group consisting of an alkyl group, an aryl group, an alkylthio group, an arylthio group, an alkoxy group, an aryloxy group, an amino group, an amido group, a sulfonamido group, an alkoxycarbonylamino group, a ureido group, a carbamoyl group, an alkoxycarbonyl group, a sulfamoyl group, a sulfonyl group, a cyano group, a halogen atom, an acyl group, a carboxy group, a sulfo group, a nitro group, a heterocyclic group and $-(\text{Time})_T X$, and these substituents may connect with each other to form a saturated or unsaturated carbocyclic group or a saturated or unsaturated heterocyclic group.

5. A silver halide photographic material as claimed in claim 2, wherein the moiety is a hydroquinone.

6. A silver halide photographic material as claimed in claim 1, wherein the timing group represented by Time is selected from one or more of groups represented by the general formulae (T-1) to (T-10) shown below, wherein a symbol (*) denotes the position at which the oxidation reduction moiety is bonded and a symbol (**) denotes the position at which X is bonded:

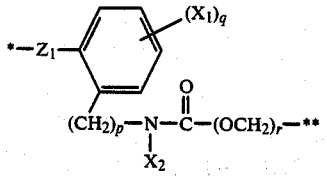

(T-1)

wherein $Z_1$ represents

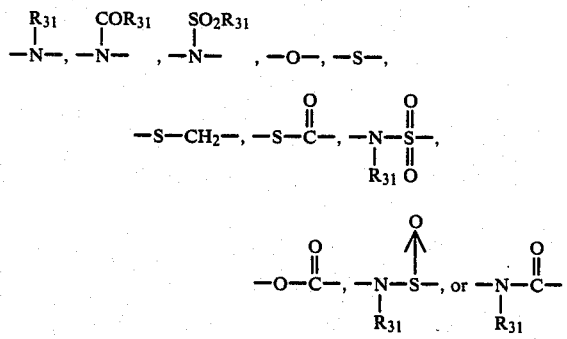

wherein $R_{31}$ represents a hydrogen atom, an aliphatic group, an aromatic group or a heterocyclic group; $X_1$ represents a hydrogen atom, an aliphatic group, an aromatic group, a heterocyclic group,

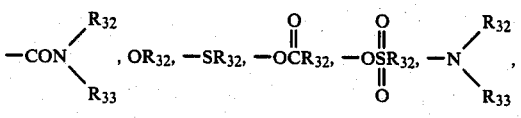

-continued

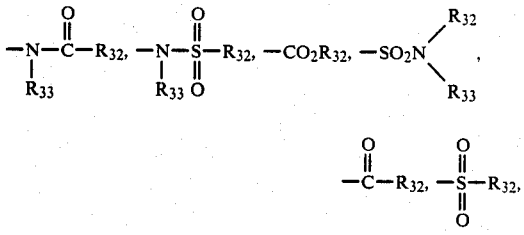

a cyano group, a halogen atom or a nitro group wherein $R_{32}$ and $R_{33}$ may be the same or different and each represents the same group as defined for $R_{31}$; $X_2$ represents the same group as defined for $R_{31}$; q represents an integer of from 1 to 4, and when q is 2 or more, the substituents represented by $X_1$ may be the same or different, and when q is 2 or more, $X_1$ may connect with each other to form a ring; p represents 0, 1 or 2; and r represents 0 or 1;

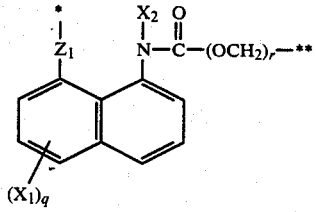

(T-2)

wherein $Z_1$, $X_1$, $X_2$, q and r each has the same meaning as defined for the general formula (T-1);

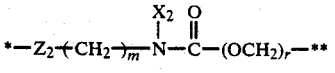

(T-3)

wherein $Z_2$ represents

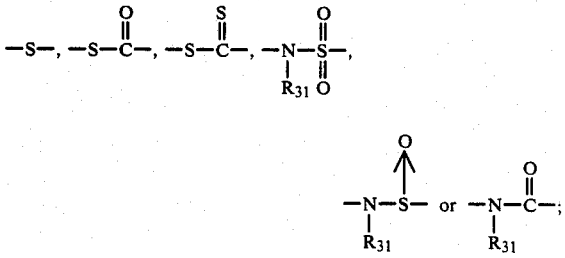

m represents an integer of from 1 to 4; and $R_{31}$, $X_2$ and r each has the same meaning as defined for the general formula (T-1);

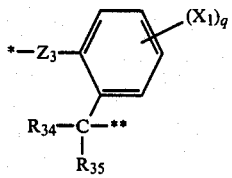

(T-4)

wherein $Z_3$ represents $$-O-,\ -S-\ \text{or}\ -\overset{R_{36}}{\overset{|}{N}}-$$

wherein $R_{36}$ represents an aliphatic group, an aromatic group, an acyl group, a sulfonyl group or a heterocyclic group; $R_{34}$ and $R_{35}$ each has the same meaning as $R_{31}$ defined for the general formula (T-1); and $X_1$ and q each has the same meaning as defined for the general formula (T-1);

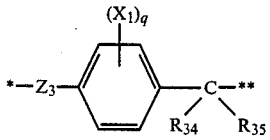

(T-5)

wherein $Z_3$, $X_1$, $R_{34}$, $R_{35}$ and q each has the same meaning as defined for the general formula (T-4);

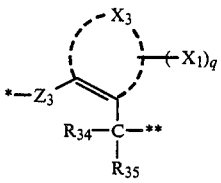

(T-6)

wherein $X_3$ represents an atomic group which comprises at least one atom selected from a carbon atom, a nitrogen atom, an oxygen atom and a sulfur atom and which is necessary to form a 5-membered, 6-membered or 7-membered heterocyclic ring, which may be further condensed with a benzene ring or a 5-membered, 6-membered or 7-membered heterocyclic ring; and $R_{34}$, $R_{35}$, $Z_3$, $X_1$ and q each has the same meaning as defined for the general formula (T-4);

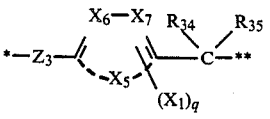

(T-7)

wherein $X_5$ represents an atomic group which comprises at least one atom selected from a carbon atom, a nitrogen atom, an oxygen atom and a sulfur atom and which is necessary to form a 5-membered, 6-membered or 7-membered heterocyclic ring, which may be further condensed with a benzene ring or a 5-membered, 6-membered or 7-membered heterocyclic ring; $X_6$ and $X_7$ each represents $$-\overset{R_{37}}{\overset{|}{C}}=\ \text{or}\ -N=$$

wherein $R_{37}$ represents a hydrogen atom, an aliphatic group or an aromatic group; and $R_{34}$, $R_{35}$, $Z_3$, $X_1$ and q each has the same meaning as defined for the general formula (T-4);

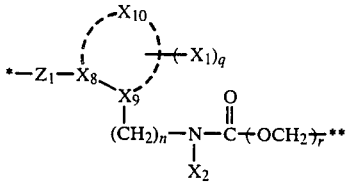

(T-8)

wherein $X_{10}$ represents an atomic group which comprises at least one atom selected from a carbon atom, a nitrogen atom, an oxygen atom and a sulfur atom and which is necessary to form a 5-membered, 6-membered or 7-membered heterocyclic ring, which may be further condensed with a benzene ring or a 5-membered, 6-membered or 7-membered heterocyclic ring; $X_8$ and $X_9$ each represents $$-\overset{|}{C}=\ \text{or}\ -\overset{|}{N}-;$$

and $Z_1$, $X_1$, $X_2$, n, q and r each has the same meaning as defined for the general formula (T-1);

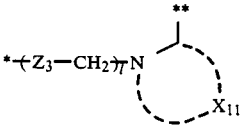

(T-9)

wherein $X_{11}$ has the same meaning as $X_{10}$ defined for the general formula (T-8); $Z_3$ has the same meaning as defined for the general formula (T-4); and l represents 0 or 1;

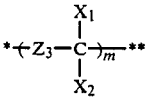

(T-10)

wherein $X_1$ and $X_2$ each has the same meaning as defined for the general formula (T-1); $Z_3$ has the same meaning as defined for the general formula (T-4); and m has the same meaning as defined for the general formula (T-3).

7. A silver halide photographic material as claimed in claim 6, wherein the heterocyclic ring of

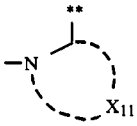

in the general formula (T-9) represents

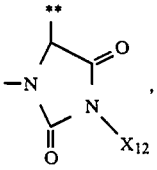

-continued

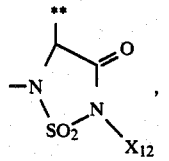

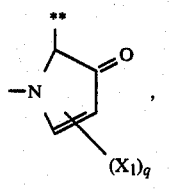

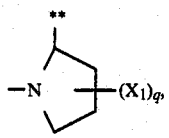

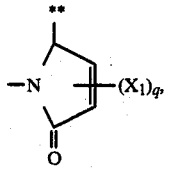

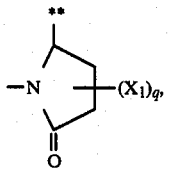

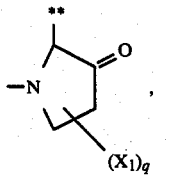

or

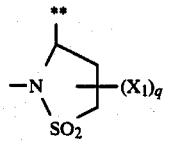

wherein $X_1$ and q each has the same meaning as defined for the general formula (T-1); and $X_{12}$ represents a hydrogen atom, an aliphatic group, an aromatic group, an acyl group, a sulfonyl group, an alkoxycarbonyl group, a sulfamoyl group, a heterocyclic group or a carbamoyl group.

8. A silver halide photographic material as claimed in claim 1, wherein the polar substituent represented by Z is selected from a substituted or unsubstituted amino group, a quaternary ammoniumyl group, a substituted or unsubstituted alkoxy group, a substituted or unsubstituted aryloxy group, a substituted or unsubstituted alkylthio group, a substituted or unsubstituted arylthio group, a substituted or unsubstituted heterocyclic oxy group, a substituted or unsubstituted heterocyclic thio group, a substituted or unsubstituted sulfonyl group, a substituted or unsubstituted carbamoyl group, a substituted or unsubstituted sulfamoyl group, a substituted or unsubstituted carbonamido group, a substituted or unsubstituted sulfonamido group, a substituted or unsubstituted acyloxy group, a substituted or unsubstituted ureido group, a substituted or unsubstituted acyl group, a substituted or unsubstituted thioureido group, a substituted or unsubstituted sulfonyloxy group, a substituted or unsubstituted heterocyclic group, a cyano group and a substituted or unsubstituted alkoxycarbonyl group.

9. A silver halide photographic material as claimed in claim 1, wherein R represents a straight chain or branched chain alkylene group, Y represents $$-S- \text{ or } -NH\overset{O}{\overset{\|}{C}}NH-,$$

Z represents a substituted or unsubstituted amino group or a substituted or unsubstituted heterocyclic group and n represents 1.

10. A silver halide photographic material as claimed in claim 1, wherein the compound represented by the general formula (I) is present in a silver halide emulsion layer.

11. A silver halide photographic material as claimed in claim 1, wherein the silver halide photographic material is a silver halide color photographic material.

12. A silver halide photographic material as claimed in claim 11, wherein the silver halide photographic material comprises at least one red-sensitive silver halide emulsion layer, at least one green-sensitive silver halide emulsion layer and at least one blue-sensitive silver halide emulsion layer.

13. A silver halide photographic material as claimed in claim 12, wherein at least one of the red-sensitive silver halide emulsion layers contains a cyan color image-forming coupler, at least one of the green-sensitive silver halide emulsion layers contains a magenta color image-forming coupler and at least one of the blue-sensitive silver halide emulsion layers contains a yellow color image-forming coupler.

14. A silver halide photographic material as claimed in claim 1, wherein the silver halide photographic material is a silver halide black-and-white photographic material.

* * * * *